US006241248B1

(12) United States Patent
Winter

(10) Patent No.: US 6,241,248 B1
(45) Date of Patent: Jun. 5, 2001

(54) INTERLOCKING SOLID PUZZLES WITH SLIDING MOVEMENT CONTROL MECHANISMS

(76) Inventor: Stephen J. Winter, 11911 NW. 31st Pl., Sunrise, FL (US) 33323

( * ) Notice: Subject to any disclaimer, the term of this patent is extended or adjusted under 35 U.S.C. 154(b) by 0 days.

(21) Appl. No.: 09/369,003

(22) Filed: Aug. 5, 1999

(51) Int. Cl.[7] ..... A63F 9/12
(52) U.S. Cl. ..... 273/153 S; 273/156
(58) Field of Search ..... 273/153 R, 153 B, 273/157 R, 156; 446/124, 127

(56) References Cited

U.S. PATENT DOCUMENTS

| | | | | |
|---|---|---|---|---|
| 615,381 | | 12/1898 | Brockett . | |
| 1,245,440 | * | 11/1917 | Converse | 446/127 |
| 1,531,542 | * | 3/1925 | Cogshall | 273/157 R |
| 2,800,743 | * | 7/1957 | Meehan et al. | 446/127 |
| 3,513,589 | * | 5/1970 | Fischer | 446/127 |
| 3,672,681 | * | 6/1972 | Wolf | 273/157 R |
| 3,721,448 | | 3/1973 | Coffin . | |
| 4,109,409 | * | 8/1978 | Fischer | 446/127 |
| 4,153,254 | | 5/1979 | Marc . | |
| 4,357,016 | | 11/1982 | Allison . | |
| 4,526,372 | * | 7/1985 | Kikis | 273/153 S |
| 4,662,638 | | 5/1987 | Vachek . | |
| 4,872,682 | | 10/1989 | Kuchimanchi . | |
| 4,874,176 | | 10/1989 | Auerbach . | |
| 4,880,238 | | 11/1989 | Derouin . | |
| 4,889,340 | | 12/1989 | Greene . | |
| 4,927,150 | | 5/1990 | Monoyios . | |
| 5,040,797 | | 8/1991 | Dykstra . | |
| 5,106,093 | * | 4/1992 | Engel | 446/124 |
| 5,302,148 | * | 4/1994 | Heinz | 273/153 S |
| 5,419,558 | | 5/1995 | Jones . | |
| 5,452,895 | | 9/1995 | Ray . | |
| 5,564,703 | | 10/1996 | McGuire . | |
| 5,775,046 | * | 7/1998 | Fanger et al. | 446/127 |
| 5,823,530 | | 10/1998 | Yang . | |
| 5,826,873 | | 10/1998 | Lavermicocca . | |

OTHER PUBLICATIONS

Puzzles Old & New, by J. Slocum & J. Botermans, published by Plenary Publications Int. pp. 62–85.
The Puzzling World of Polyhedral Dissections, by Stewart Coffin, Ch. 4 (available on–line at the following Internet Address: http://www.johnrausch. com.

* cited by examiner

*Primary Examiner*—Steven Wong
(74) *Attorney, Agent, or Firm*—Stearns, Weaver, Miller, Weissler, Alhadeff & Sitterson P.A.

(57) ABSTRACT

An interlocking three-dimensional solid puzzle having component pieces that can be interlocked into an assembled configuration without any significant internal voids. The component pieces include sliding control mechanisms to control movement of the pieces and are preferably structured such that specific movement of one or more pieces is required before any piece can be removed. The sliding control mechanism preferably includes an array of mating projecting studs and channels on the individual puzzle pieces that cooperate to selectively limit movement of the pieces, and or provide false moves that do not advance assembly and/or disassembly. The present invention provides a new class of interlocking solid puzzles characterized as being challenging to assemble and disassemble while having a lower piece count than comparable existing puzzles.

32 Claims, 8 Drawing Sheets

INTERLOCKING SOLID PUZZLES WITH SLIDING MOVEMENT CONTROL MECHANISMS

CROSS REFERENCE TO RELATED APPLICATIONS

STATEMENT REGARDING FEDERALLY SPONSORED RESEARCH OR DEVELOPMENT

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates games and amusement devices, and specifically to three-dimensional puzzles with sliding interlocking pieces, and more particularly to puzzles having pieces that require sequential movement of the pieces during assembly and disassembly.

2. Description of the Background Art

Interlocking solid puzzles of many types have existed and have been a source of enjoyment for many years. A major challenge in this field is in coming up with new puzzles that are appealing in ways that will capture the interest of consumers.

Prior art on puzzles can be found in "Puzzles Old & New", by J. Slocum & J. Botermans, copyright 1986, published by Plenary Publications Int., The Netherlands. Page 62 through 85 in the section on interlocking solid puzzles provides a good characterization of interlocking solid puzzle. This information can also be used to distinguish them from other types of puzzles such a jigsaw puzzles. This section covers the well known 6 piece burr puzzles. In the ideal versions of these puzzles the number of notches applied to the bars are such that no empty spaces exist in the assembled puzzle. One of the problems with these ideal versions is that a piece can always be removed from the assembled puzzle without requiring shifts of other pieces. This makes these puzzles less challenging to disassemble. More challenging burr puzzles are covered that require one or more shifts before an initial piece can be removed, however, this requires additional notches and results in empty spaces in the assembled puzzle. This is a drawback that causes the puzzle to be less aesthetically and mathematically pleasing. Another problem with the burr puzzle is the difficulty in using an existing puzzle to create a more challenging one with more shifts required for disassembly. For example just the smallest change in the position or shape of a notch will often ruin the puzzle, such that it can no longer be assembled into the burr shape. While the 6 piece burr puzzles have a visually appealing assembled form, a partially assembled puzzle seldom results in a interesting or visually stimulating arrangement. Besides the assembled form of the burr puzzle, creative arrangements of pieces that are visually stimulating or interesting are difficult to find.

One of the other types of interlocking solid puzzles covered within pages 62–85 of "Puzzles Old & New" are those with complex geometric forms. These include a dodecahedron shaped puzzle on page 62, a hexagonal puzzle on page 69, the puzzles called Lightning, Grand Prix, and Kubion on page 76, the puzzles called Cuckoo Nest, and Locked Nest on page 82, the three polyhedral puzzles on page 84, and the puzzle called Jupiter on page 85. While these puzzles can be considered works of art, in order to make these puzzles challenging, a large number of pieces is often required. A problem here is that puzzles with a large number of pieces are less popular as such puzzles are difficult for the average puzzle enthusiast to assemble. Although they have a very visually appealing assembled form, these geometric form puzzles are often easy to disassemble. Many do not require shifts or other movement of a piece before an initial piece or pieces can be removed from the assembled puzzle. Many of these types of puzzles are not stable in assembled form, or in many of the stages of assembly of the puzzle. The problem with this instability is that the puzzle can easily fall apart unless carefully supported, such as being held together by hand.

Prior art on interlocking solid puzzles is also covered at the Puzzle World web site on the Internet at address "http://www.johnrausch.com/PuzzleWorld/index.html". This site contains an on-line version of the book "The Puzzling World of Polyhedral Dissections," by Stewart Coffin. Chapter 4 of this on-line book covers Interlocking Block Puzzles that have the assembled form of a cube. This chapter discusses the difficulty in designing puzzles up to size-five. A size-four puzzle called the Convolution puzzle is presented that illustrates this difficulty. This shows that designers often have to revert to deformities to the basic cubic structures in order to create interesting cube puzzles of this size.

Another related type of interlocking solid puzzle is one that incorporates a maze while still being an assembly and disassembly puzzle. An example is U.S. Pat. No. 4,357,016 (1982) to Allison. This puzzle, and others of its type, have the disadvantage that piece movements are restricted to that along a defined surface within the puzzle. This surface is often planar, but can include other smooth surfaces such as that of a cylinder as proposed by Allison. This surface is often defined by a single piece frame member, but can use a frame formed by multiple members. Contact, between the frame and other pieces, is used to maintain the pieces in assembled form. An example is in the patent by Allison which includes a version where the surface is that of a cylinder defined by the inner surface of a single cylinder member, and another version where the surface is that of a cylinder defined by the surface of a plurality of stacked cylindrical bands. Another disadvantage of this type of puzzle is that a frame is required to maintain the pieces in assembled form.

BRIEF SUMMARY OF THE INVENTION

Accordingly, several objects and advantages of my invention are:

It is an object of the present invention to provide a puzzle without significant internal voids in its assembled form, which requires the movement of one or more pieces before any piece can be removed;

Still another object of the invention is to provide a more challenging version of an existing puzzle, without altering the basic shape of the pieces of the original puzzle;

Yet another object of the present invention is to provide a puzzle which can easily have its pieces interlocked in various visually stimulating or interesting arrangements other than the assembled form, or partially assembled forms of the puzzle;

Still another object of the present invention is to provide a puzzle that has a complex geometric assembled form, is challenging to assemble, and has a lower piece count than comparable existing puzzles;

A further object of the present invention is to provide a puzzle without objectionable deformities to the basic puzzle piece structure, that has a small size characteristic that has been difficult or impossible to achieve in existing puzzles;

Yet another object of the present invention is to provide a more stable version of an existing puzzle, such that there exist more puzzle piece configurations, during stages of assembly, which do not easily fall apart;

Another object of the present invention is to provide a puzzle with a new mechanism for controlling the movement of puzzle pieces;

A further object of the present invention is to provide a new class of interlocking solid puzzles which are appealing in ways that will capture the interest of consumers;

Yet another object of the invention is to provide a puzzle that can have a small number of pieces so as to appear simple, but can be very challenging to assemble;

Still another object of the present invention is to provide a puzzle that incorporates false moves that are not required to solve the puzzle, but which make the puzzle more challenging;

A further object of the present invention is to provide a puzzle where movement of puzzle pieces is not restricted to that along a single defined smooth surface within the puzzle;

Yet another object of the present invention is to provide a puzzle where the general shape of pieces can be based on a virtually unlimited number of different geometric shapes; and A further object of the present invention is to provide a puzzle that does not require a frame to maintain puzzle pieces in assembled form;

Still further objects and advantages will become apparent from a consideration of the ensuing description and drawings.

Reference Numerals in Drawings

| | | | |
|---|---|---|---|
| 20 | Cuboid | 105 | Stud |
| 21–23 | Cuboid face | 106–111 | Channel |
| 24–27 | Cuboid edge | 120 | Channel |
| 28 | Stud | 124–125 | Stud |
| 29–32 | Channel | 130–135 | Channel |
| 33–34 | Channel side wall | 136 | mating cavity |
| 35 | Cuboid | 140 | Stud |
| 36 | Mating cavity | 142–143 | Channel |
| 37 | Channel | 146–147 | Stud |
| 38 | Mating region | 200 | Cuboid |
| 39–40 | Channel | 201–203 | Cylindrical stud |
| 41 | Cuboid | 210 | Cuboid |
| 42–45 | T-channel | 211–213 | Channel |
| 46 | T-stud | 220 | Cuboid |
| 47 | Stud neck | 221–225 | Channel |
| 48 | Stud head | 230 | Cuboid |
| 49 | T-mating cavity | 231–233 | Dovetail Channel |
| 50 | Puzzle piece | 240 | Cuboid |
| 51–53 | Cuboid | 241–242 | Wall |
| 60 | Puzzle piece | 243 | Cuboid face |
| 61–75 | Cuboid | 245 | Stud |
| 80 | Puzzle piece | 250 | Cuboid |
| 90 | Puzzle piece | 251–252 | Wall |
| 91–98 | Cuboid | 253 | Cuboid face |
| 100–104 | Channel | 255 | Stud |

DETAILED DESCRIPTION OF THE INVENTION

A uniform coordinate system with mutually perpendicular X, Y, and Z axes is included in FIGS. 1 to 18F to provide a fixed reference frame. This is reference frame is used in all descriptions to indicate the X, −X, Y, −Y, Z, and −Z direction. This reference is also used to indicate a particular surface of a part. The surface of a part facing in the X direction would be designated the X part face. Likewise −X, Y, −Y, Z and −Z are used in the designation of other faces of parts.

Figure 1:
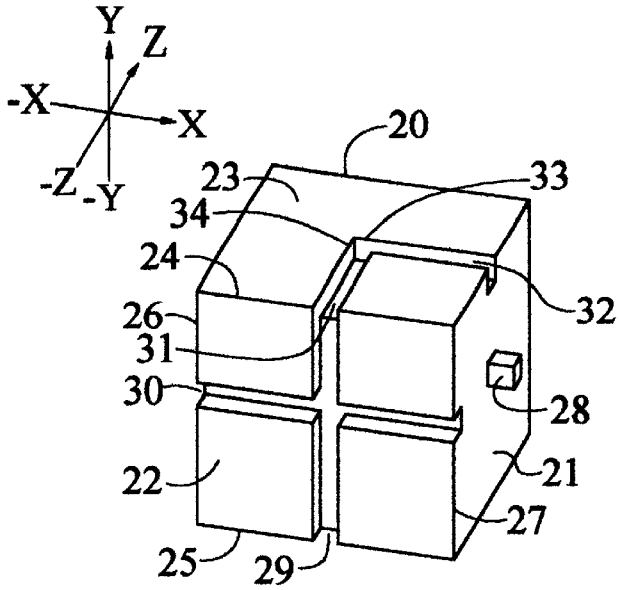
FIG. 1 shows a perspective view of a cuboid with a stud and channels formed on a plurality of surfaces thereof.

FIG. 1 shows a perspective view of a cube shaped member, or cuboid 20. A cuboid is defined herein as a cube with possible protrusions and recessed areas, or voids on the various cube faces. Also the cuboids in all the figures are in parallel alignment. Parallel alignment is defined herein to describe the orientation of a member wherein each of its edges parallel to either the X, Y, or Z axis. Cuboid 20 is a cube defining a protrusion, or stud 28, and slots or channels 29, 30, 31, and 32. Other than for the addition of the stud and channels, cuboid 20 has the shape of a cube.

The surface of cuboid 20 facing in the Y direction, or cuboid face 23, is the same shape as a cube face (i.e. planar square surface) except that it defines voids, namely channels 29, 31, and 32 cut into the surface of cuboid face 23. Likewise cuboid face 22 is the same shape as a cube face except that it defines voids where channels 31, 29, and 30 cut into the surface. Cuboid face 21 is the same shape as a cube face except it has voids where channels 30 and 32 cut away the surface. Cuboid face 21 is planar and includes the area where stud 28 projects normal therefrom. The edge of a cuboid, or cuboid edge, is the same as that of an edge of a cube except for voids created where the various channels intersect the various edges and are cut into the cube. Cuboid edge 24 is the same shape as a cube edge except for a void caused by channel 31. Cuboid edge 25 is the same shape as a cube edge except for a void caused by channel 29. Cuboid edge 26 and 27 are the same shape as a cube edge except for voids caused by channel 30.

The width of a cuboid is defined as the distance between opposite cuboid edges of a cuboid face, measured in a direction perpendicular to these edges. The width of a cuboid in any direction does not include the distance that a stud protrudes from a cuboid face. The width of cuboid 20 is the distance from cuboid edge 26 to cuboid edge 27 measured in the X direction.

In the preferred embodiment the studs have the shape of a cube, and are of the same size. In addition, the studs projecting from a cuboid face are centrally attached to this cuboid face. Centrally attached being defined as being joined with flush parallel faces, and with each edge on one face being parallel to an edge of the joined face, and the centers of the joined faces being adjacent and aligned. Stud 28 is centrally attached to cuboid face 21.

Channels in FIGS. 1, 2, and 4 to 17 have the property that they are a void with the shape of a rectangular parallelepiped, or box, with an equal depth and width, and with a length greater than or equal to their width. As defined herein a channel is located at the face of a cuboid such that its depth is cut into the cuboid in a direction into this cuboid face. Channels in FIGS. 1, 2, and 4 to 17 also have the property that the length and width of a channel both run in a direction along the plane of the cuboid face, and parallel to an edge of this cuboid face. Channels in FIGS. 1, 2, 4 to 17, and 18B to 18D also have the property that the channel depth is uniform over the entire channel. This uniform depth gives these channels a planar surface at the extreme depth of the channel, or a channel floor, which is parallel to the cuboid face into which the channel is cut. A channel side wall is defined herein as the cuboid material defining the sides of the channel along the channel's length. A vertical channel side wall is defined herein as a channel side wall that is perpendicular to the cuboid face into which the channel is cut. Channels in FIGS. 1, 2, and 4 to 17 have vertical channel side walls. Channels in FIGS. 1, 2, and 4 to 17 also are formed about a center line such that the channel side walls are spaced equidistant from the channel center line. The term channel side wall is used to reference the solid material on the side wall of a channel. A channel end wall is defined herein as the cuboid material located across the width of a channel at a channels extreme length. In other words the term channel end wall is used to reference the solid material that may exist at the end of a channel. A vertical channel end wall is defined herein as a channel end wall that is perpendicular to the cuboid face into which the channel is cut.

Channels in FIGS. 1, 2, and 4 to 17 have the property that the channel, and its center line, runs along a middle line of a cuboid face. This is such that the distance from a channel side wall to its closest parallel cuboid edge on the same cuboid face, and in a direction along this cuboid face perpendicular to the length of the channel and away from the channel, is the same as that for the opposite channel side wall. Channels here also have the property that they have the same width and depth, but can have different lengths. The width of these channels is substantially the same as that of the studs shown in these same figures. It may be slightly larger than that of the stud such that a stud can be inserted and move within a channel with a desired amount of friction. The depth of channel 29 is measured in the Z direction from cuboid face 22. The length of channel 29 runs parallel to the Y axis. The width of channel 29 runs parallel to the X axis. Channel side wall 33 is parallel to cuboid face 22. Channel side wall 34 is parallel to cuboid face 21. Channel 31 runs in a direction along the Z axis, and along the Y cuboid face of cuboid 20. Channel 32 runs in a direction along the X axis, and along the Y cuboid face of cuboid 20. A central channel is defined herein as a channel that runs from a cuboid edge, through the center of a cuboid face, with a distance equal to one half the width of the cuboid plus one half the width of a channel. A direction will also be associated with a central channel, this being the direction along the length of the central channel, from the center of the cuboid face to the cuboid edge. For example, channel 32 is a central channel on the Y cuboid face with a X direction. Channel 31 is a central channel on the Y cuboid face with a −Z direction. Channel 29 runs in a direction along the Y axis, and along the entire width of the −Z cuboid face of cuboid 20. Channel 30 runs in a direction along the X axis, and along the entire width of the −Z cuboid face of cuboid 20.

Figure 2:
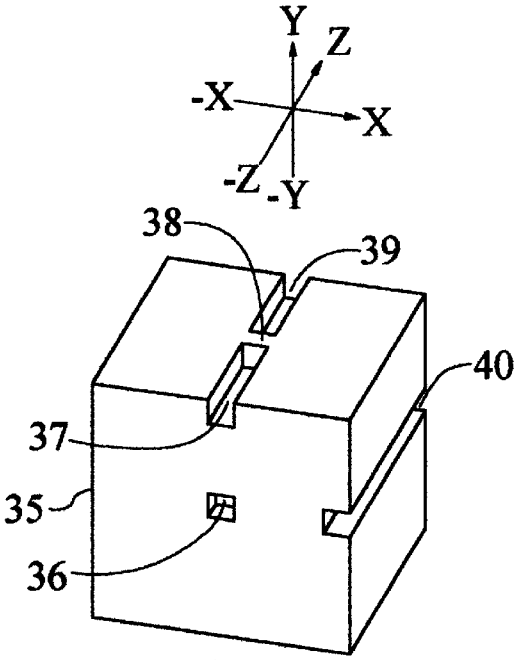
FIG. 2 shows a perspective view of a cuboid with a mating cavity and channels formed on a plurality of surfaces thereof.

FIG. 2 shows a perspective view of a cuboid, referenced as 35, with a mating cavity and several channels. Cuboid 35 is a cube defining channels 37, 39, and 40. It also defines a small cube shaped void, or mating cavity 36. Any mating cavity shown in FIGS. 1, 2, and 4 to 17 has the property of having the substantially the same cubic size as that of a stud shown in these figs (e.g. stud 28). The width and depth measurements of a mating cavity may be slightly larger than that of the stud such that a stud can be inserted into a mating cavity with a desired amount of friction. A mating cavity here also has the property that it is located at the center of a cuboid face. This is such that when a cuboid face with a stud is flush with a cuboid face with a mating cavity, and the edges of the cuboid faces that are in contact are parallel, then the stud will be located within the mating cavity. Channel 37 starts at the −Z face of cuboid 35 and runs along the Y cuboid face in a direction parallel to the Z axis. It has a length equal to one half the cuboid width minus one half the channel width. Channel 39 starts at the Z face of cuboid 35 and runs along the Y cuboid face in a direction parallel to the Z axis. It has the same length as channel 37. Channel 40 runs along the entire width of the X face of cuboid 35 in a direction parallel to the Z axis. The volume of space where a mating cavity could be located on a cuboid face is defined as a mating region. Mating region 38 is located on at the Y cuboid face of cuboid 35. It comprises the volume between channels 37 and 39, and particularly between the end walls of channels 37 and 39. Since mating region 38, on cuboid 35, is not void of material there is not a mating cavity at this location. A cuboid face is a planar shape, the same as that of a cube face except it defines voids anywhere channels cut away the surface, it further defines voids anywhere mating cavities cut the surface, and it includes the surface area where a stud is attached.

Figure 3:
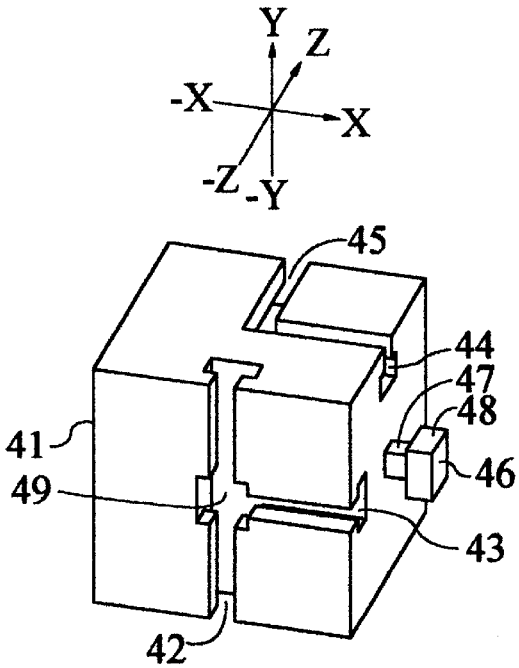
FIG. 3 shows a perspective view of a cuboid having an alternate embodiment of studs and channels.

FIG. 3 shows a perspective view of a cuboid with an alternate configuration of captive type studs and channels. This alternate captive type configuration has a profile the shape of the capital letter T, so a T prefix will be will be used in the names. Attached to the X cuboid face of cuboid 41 is a protrusion with a T-shaped profile, or T-stud 46. T-stud 46 is made of a cube shaped member, or neck 47, and a rectangular parallelepiped, box, or head 48. Neck 47 is centrally attached to the X cuboid face of cuboid 41. Head 48 has a width in the X direction that is the same as the width of neck 47. Head 48 has a width in the Y and Z direction that is two times the width of neck 47. Head 48 is centrally attached to neck 47. On the Y cuboid face there is a void, or slot with a T shaped profile, or T-channel 44. A T-channel can be described as being made of two adjacent voids. The first void has the same properties as that of the channels in FIGS. 1 and 2. It has the same width, depth and centered location on a cuboid face. The second void is located directly below the first void in the direction away from the cuboid face, with an otherwise identically centered location. It has the same depth as the first void but has twice the width. Also it has a length that extends beyond that of the ends of the first void by one half the width of the stud neck. This additional length allows for the difference between the width of the stud neck and the width of the stud head. The edges along the length of the second void are also parallel to that of the first void. FIG. 3 shows T-channels with these properties. T-channel 44 extends part way across the Y cuboid face in a −X direction, starting from the X cuboid face. T-channel 45 extends part way across the Y cuboid face in a −Z direction, starting from the Z cuboid face. T-channel 43 extends part way across the −Z cuboid face in a −X direction, starting from the X cuboid face. T-channel 42 extends the width of the −Z cuboid face in a direction parallel to the Y axis. At the center of the −Z cuboid face there is a cube shaped void, or T-mating cavity 49, with the same dimensional extents as a T-stud. The lengths of the edges of T-mating cavity 49 is equal to two times the width of neck 47. Other than for the size, the T-mating cavity 49 is located at the center of a cuboid face just as is mating cavity 36 in FIG. 2. T-mating cavity 49 is shown located at the center of the −Z cuboid face. The T-channel functions to hold the T-stud captive thereby preventing separation of the pieces. The invention further contemplates a variety of alternate captive type structures such as stud profiles and corresponding mating cavity shapes including L-shaped, triangular and inverted truncated triangular (e.g. dove tail), and studs having a bulb-type end.

Figure 4:
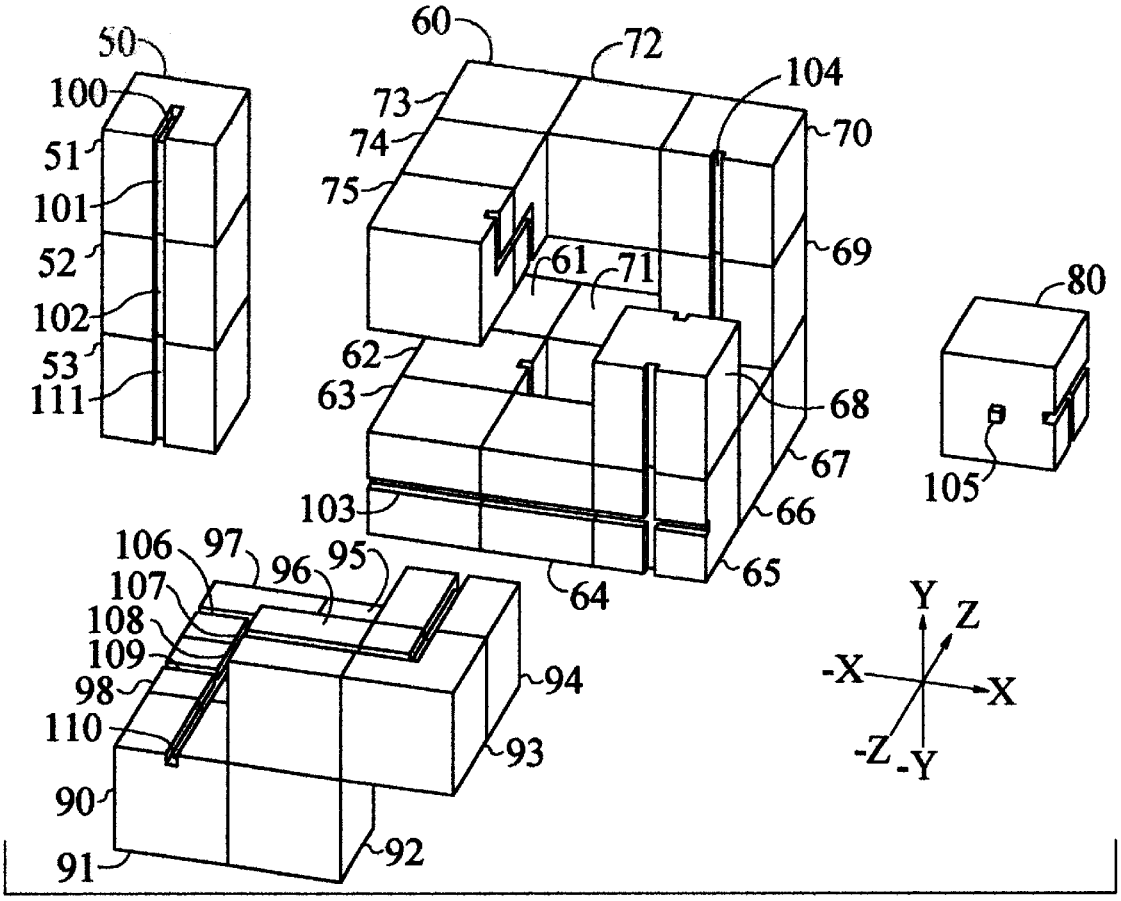
FIG. 4 shows an exploded front perspective view of a puzzle according to the present invention.
Figure 5:
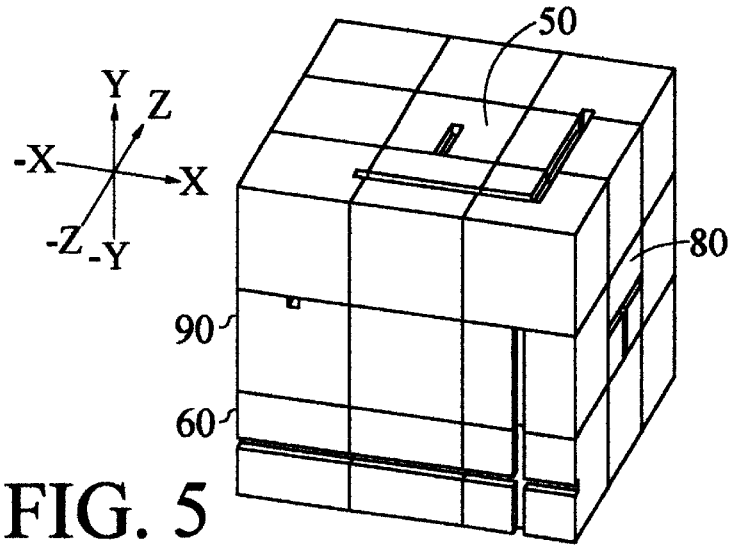
FIG. 5 shows an assembled front perspective view of the puzzle shown in FIG. 4.

FIGS. 4 and 5 show an embodiment of a puzzle according to the present invention in disassembled and assembled configurations respectively. FIG. 4 shows an exploded perspective view of a puzzle as a means of depicting a disassembled puzzle configuration. The puzzle consists of puzzle pieces 50, 60, 80 and 90. Puzzle piece 50 in FIG. 4 consists of 3 cuboids, namely cuboids 51, 52 and 53. Cuboid 51 includes channel 101 running the length of the −Z cuboid face and parallel to the Y axis. Cuboid 51 also includes channel 100 which is a central channel on the Y cuboid face with a −Z direction. Cuboid 52 is fixedly attached to the −Y cuboid face of cuboid 51. Cuboids in FIGS. 4 through 17 have the property that when one cuboid is attached to another cuboid within a puzzle piece they are centrally attached, this includes being permanently attached. Cuboid 52 includes channel 102 running the length of the −Z cuboid face and parallel to the Y axis. Cuboid 53 is attached to the −Y cuboid face of cuboid 52. Cuboid 53 includes channel 111 running the length of the −Z cuboid face and parallel to the Y axis.

Puzzle piece 60 in FIG. 4 consists of 15 fixedly attached cuboids; namely cuboids 61 through 75. Cuboid 62 is attached to the −Z cuboid face of cuboid 61. Cuboid 63 is attached to the −Z cuboid face of cuboid 62. Cuboid 63 includes channel 103 running the length of the −Z cuboid face and parallel to the X axis. Cuboid 64 is attached to the X cuboid face of cuboid 63. Cuboid 65 is attached to the X cuboid face of cuboid 64. Cuboid 68 is attached to the Y cuboid face of cuboid 65. Cuboid 66 is attached to the Z cuboid face of cuboid 65. Cuboid 67 is attached to the Z cuboid face of cuboid 66. Cuboid 69 is attached to the Y cuboid face of cuboid 67. Cuboid 70 is attached to the Y cuboid face of cuboid 69. Cuboid 70 includes channel 104 running the length of the −Z cuboid face and parallel to the Y axis. Cuboid 72 is attached to the −X cuboid face of cuboid 70. Cuboid 73 is attached to the −X cuboid face of cuboid 72. Cuboid 74 is attached to the −Z cuboid face of cuboid 73. Cuboid 75 is attached to the −Z cuboid face of cuboid 74. Cuboid 71 is attached to the −X cuboid face of cuboid 67. Cuboid 61 is attached to the −X cuboid face of cuboid 71.

Puzzle piece 80 in FIG. 4 is made of only one cuboid so is a cuboid. Puzzle piece 80 includes stud 105 on the −Z cuboid face.

Puzzle piece 90 in FIG. 4 consists of 8 cuboids; namely cuboids 91 through 98. Cuboid 97 is attached to the −X cuboid face of cuboid 95. Cuboid 98 is attached to the −Z cuboid face of cuboid 97. Cuboid 91 is attached to the −Z cuboid face of cuboid 98. Cuboid 92 is attached to the X cuboid face of cuboid 91. Cuboid 96 is attached to the Y cuboid face of cuboid 92. Cuboid 93 is attached to the X cuboid face of cuboid 96. Cuboid 94 is attached to the Z cuboid face of cuboid 93. Cuboid 91 includes channel 110 running the length of the Y cuboid face and parallel to the Z axis. Cuboid 97 includes channel 106 which is a central channel on the Y cuboid face with a −X direction. Cuboid 97 also includes channel 107 which is a central channel on the Y cuboid face with a −Z direction. Cuboid 98 includes channel 108 running the length of the Y cuboid face and parallel to the Z axis. Cuboid 98 also includes channel 109 which is a central channel on the Y cuboid face with a −X direction.

FIG. 5 shows a perspective view, in fully assembled form, of the disassembled puzzle shown in FIG. 4. The puzzle shows puzzle pieces 50, 60, 80, and 90 arranged within the volume of a large cube that has a width that is three times that of the cuboids. The shape of the assembled puzzle is substantially that of a large cube. The only difference between this form and a large cube is what is contributed by the channels, studs, and mating cavities. The puzzle pieces in FIG. 5 have the same orientation as those in FIG. 4. This is such that any cuboid face is facing in the same direction in both figures.

Figure 6:
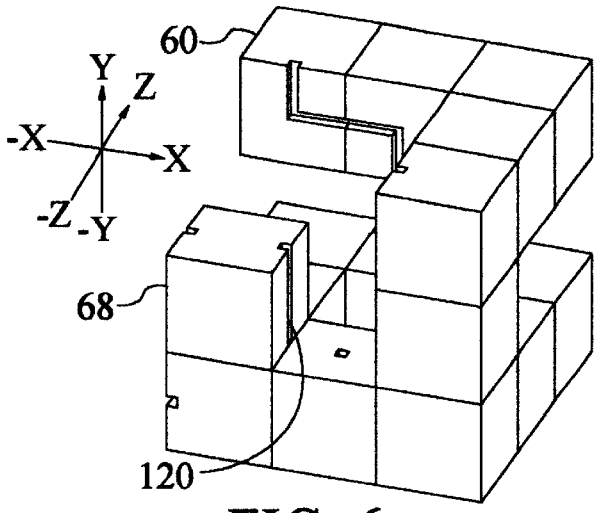
FIG. 6 shows a perspective view of puzzle piece 60 rotated 90 degrees clockwise about the Y axis relative to its position in FIG. 4.

FIG. 6 shows a perspective view of puzzle piece 60 which is rotated 90 degrees clockwise about the Y axis relative to its position shown in FIG. 4. Cuboid 68 is shown with channel 120 running the length of its X cuboid face and parallel to the Y axis.

Figure 7:
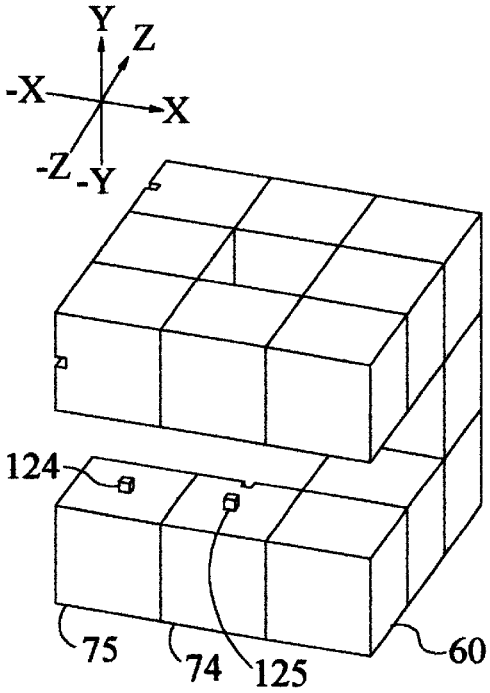
FIG. 7 shows a perspective view of puzzle piece 60 rotated 180 degrees about the X axis relative to the position shown in FIG. 6.

FIG. 7 shows a perspective view of puzzle piece 60 which is rotated 180 degrees about the X axis relative to its position shown in FIG. 6. Cuboid 75 is shown with stud 124 on its Y cuboid face. Cuboid 74 is shown with stud 125 on its Y cuboid face.

Figure 8:
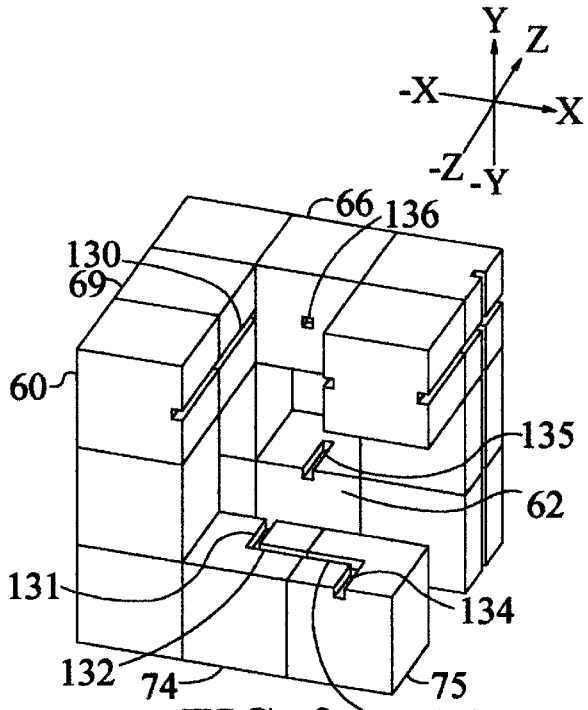
FIG. 8 shows a perspective view of puzzle piece 60 rotated 90 degrees counter-clockwise about the Y axis, and then rotated 90 degrees counter-clockwise about the X axis, relative to its position shown in FIG. 4.

FIG. 8 shows a perspective view of puzzle piece 60 which is rotated 90 degrees counter-clockwise about the Y axis, then rotated 90 degrees counter-clockwise about the X axis, relative to its position shown in FIG. 4. Cuboid 66 is shown with mating cavity 136 on its −Z cuboid face. Cuboid 69 is shown with channel 130 running the length of its X cuboid face and parallel to the Z axis. Cuboid 62 is shown with central channel 135, with a −Z direction, located on its Y cuboid face. Cuboid 74 is shown with central channel 131, with a Z direction, located on its Y cuboid face. Cuboid 74 is also shown with central channel 132, with a X direction, located on its Y cuboid face. Cuboid 75 is shown with central channel 133, with a −X direction, located on its Y cuboid face. Cuboid 75 is also shown with central channel 134, with a −Z direction, located on its Y cuboid face.

Figure 9:
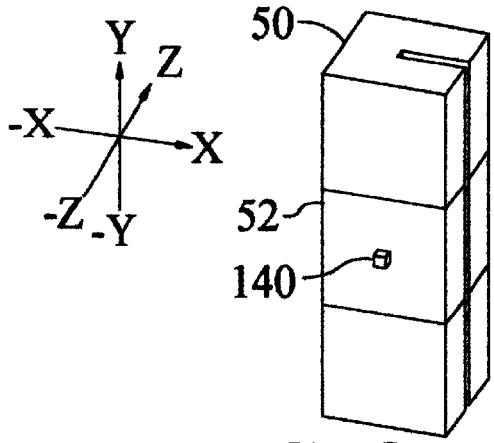
FIG. 9 shows a perspective view of puzzle piece 50 rotated 90 degrees counter-clockwise about the Y axis relative to its position shown in FIG. 4.

FIG. 9 shows a perspective view of puzzle piece 50 which is rotated 90 degrees counter-clockwise about the Y axis relative to its position shown in FIG. 4. Cuboid 52 is shown with stud 140 on its −Z cuboid face.

Figure 10:
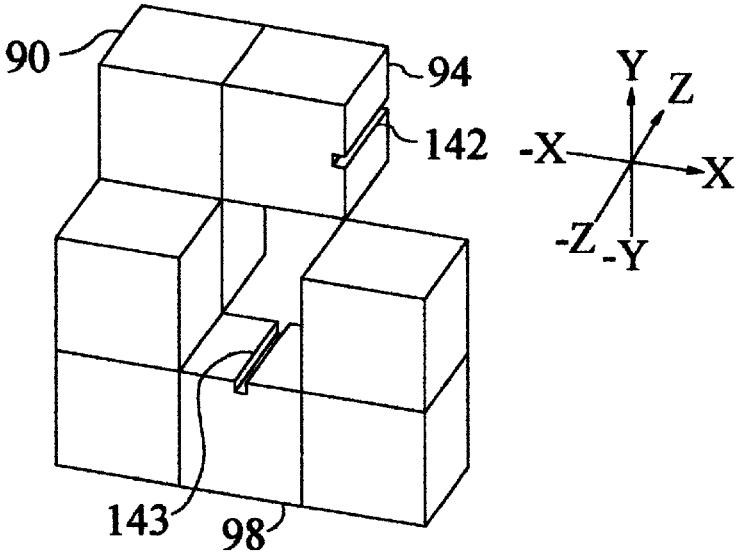
FIG. 10 shows a perspective view of piece 90 rotated 90 degrees clockwise about the Y axis, then rotated 90 degrees clockwise about the X axis, relative to its position shown in FIG. 4.

FIG. 10 shows a perspective view of puzzle piece 90 which is rotated 90 degrees clockwise about the Y axis, then rotated 90 degrees clockwise about the X axis, relative to its position shown in FIG. 4. Cuboid 94 is shown with channel 142 running the length of its X cuboid face and parallel to the Z axis. Cuboid 98 is shown with channel 143 running the length of its Y cuboid face and parallel to the Z axis.

Figure 11:
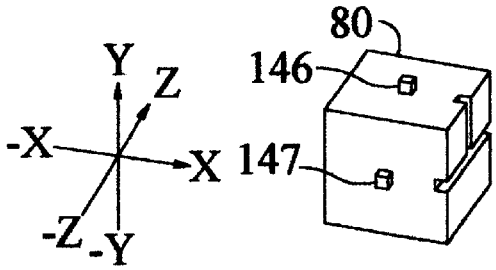
FIG. 11 shows a perspective view of piece 80 which is rotated 180 degrees about the X axis relative to its position shown in FIG. 4.

FIG. 11 shows a perspective view of puzzle piece 80 which is rotated 180 degrees about the X axis relative to its position shown in FIG. 4. Puzzle piece 80 is shown with stud 146 on its Y cuboid face, and with stud 147 on its −Z cuboid face.

Figure 12:
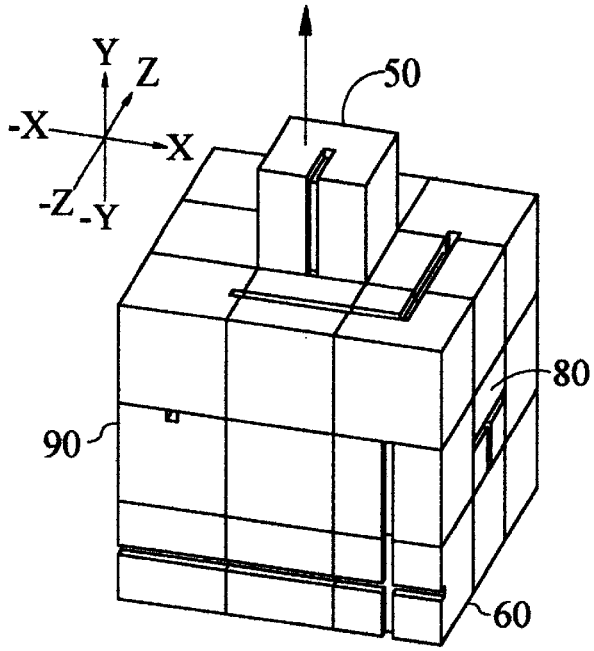
FIGS. 12 to 17 show perspective views of the various pieces of this same puzzle in different stages of disassembly with arrows indicating the direction of movement of certain pieces.

FIG. 12 shows a perspective view of puzzle pieces 50, 60, 80, and 90. This view is identical to that in FIG. 5 except puzzle pieces 50 is moved in the Y direction by an amount equal to the width of a cuboid.

Figure 13:
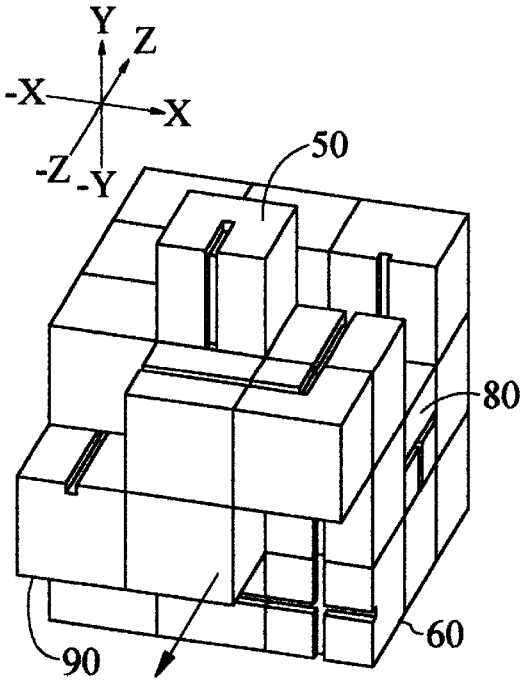

FIG. 13 shows a perspective view of puzzle pieces 50, 60, 80, and 90, with an arrow indicating puzzle piece 50 and 90 have moved. This view is identical to that in FIG. 12 except puzzle pieces 50 and 90 have moved in the −Z direction by an amount equal to the width of a cuboid.

Figure 14:
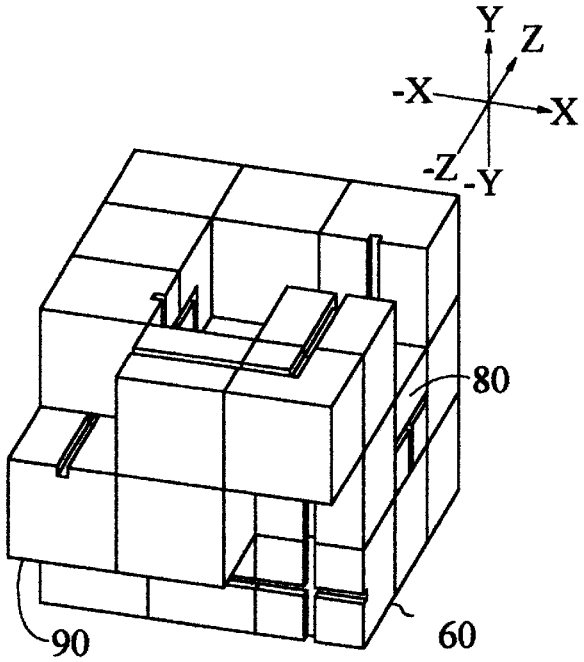

FIG. 14 shows a perspective view of puzzle pieces 60, 80, and 90. This view is identical to that in FIG. 13 except puzzle pieces 50 has been removed in the Y direction.

Figure 15:
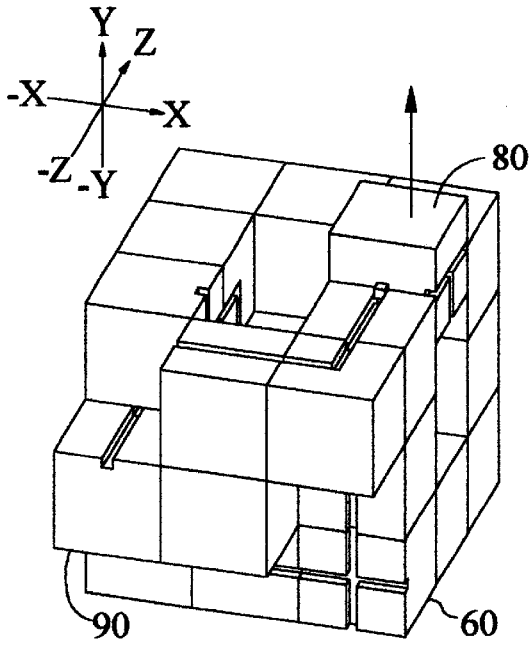

FIG. 15 shows a perspective view of puzzle pieces 60, 80, and 90, with an arrow indicating puzzle piece 80 has moved. This view is identical to that in FIG. 14 except puzzle pieces 80 is moved in the Y direction by an amount equal to 1.5 times the width of a cuboid.

Figure 16:
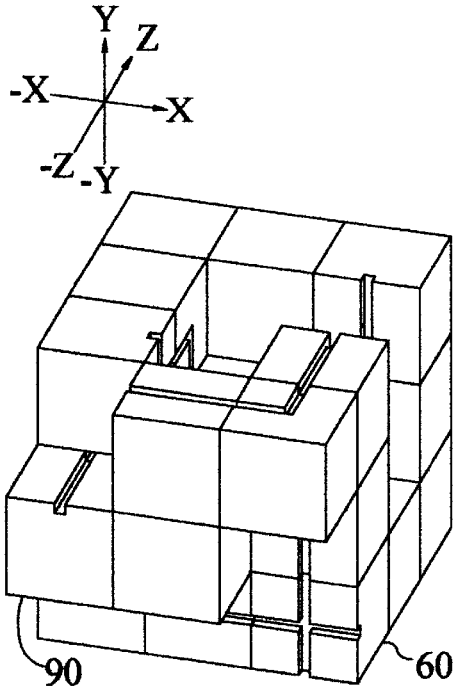

FIG. 16 shows a perspective view of puzzle pieces 60 and 90. This view is identical to that in FIG. 15 except puzzle pieces 80 has been removed in the Y direction.

Figure 17:
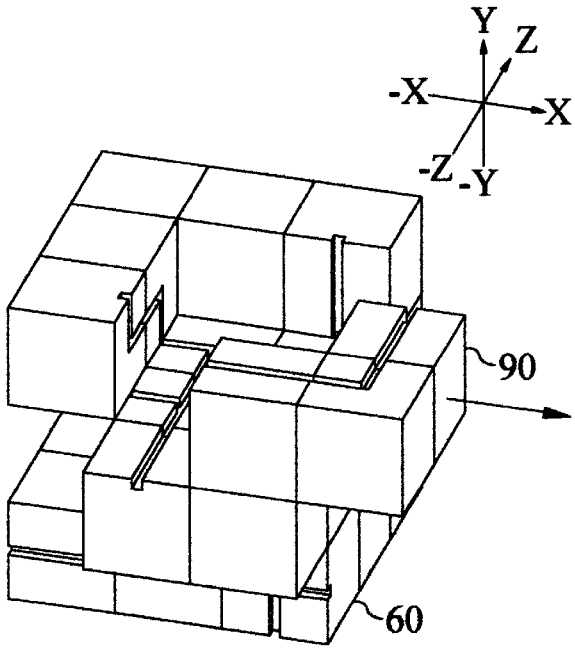

FIG. 17 shows a perspective view of puzzle pieces 60 and 90, with an arrow indicating puzzle piece 90 has moved. This view is identical to that in FIG. 16 except puzzle pieces 90 is moved in the X direction by an amount equal to the width of a cuboid.

Figure 18A:
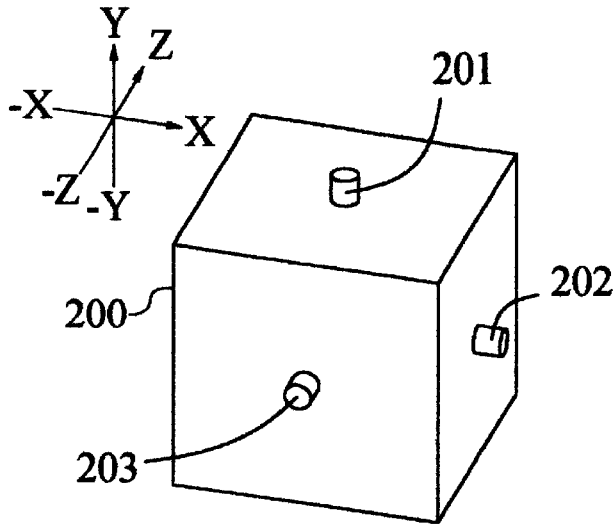
FIG. 18A shows a perspective view of a cuboid having an alternate embodiment of stud.

FIG. 18A shows a perspective view of a cuboid, referenced as 200, with an alternate embodiment of stud. Cuboid 200 is the same shape as a cube except for the addition of cylindrical stud 201, cylindrical stud 202 and cylindrical stud 203. The shape of these cylindrical studs is that of a cylinder with planar ends that are perpendicular to the axis of the cylinder. The cylindrical studs have a height and diameter the same as the height and width of the studs in the preferred embodiment (e.g. stud 105). The cylindrical studs are located at the center of cuboid faces such that they project from the face with the axis of the cylindrical stud perpendicular to the face and intersecting the center of the face, and one end of the cylindrical stud in flush contact with the face. Cylindrical stud 201 is located at the center of the +Y cuboid face of cuboid 200. Cylindrical stud 202 is located at the center of the +X cuboid face of cuboid 200. Cylindrical stud 203 is located at the center of the −Z cuboid face of cuboid 200.

Figure 18B:
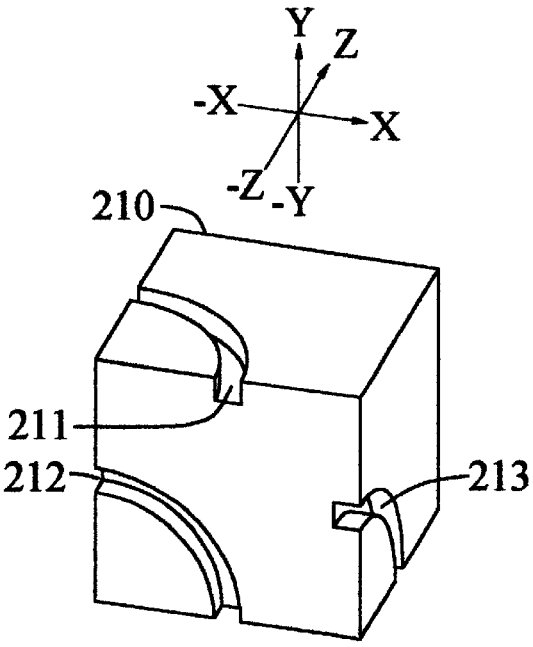
FIG. 18B shows a perspective view of a cuboid with curved channels formed on a plurality of surfaces thereof.

FIG. 18B shows a perspective view of a cuboid, referenced as 210, having three channels that are curved. Cuboid 210 is a cube defining channels 211, 212 and 213. These channels are formed about a center line such that the channel side walls are spaced equidistant from the channel center line. The channel center lines for these channels are smooth curved lines approximately the shape of one quarter of the arc of a circle. These channels also have vertical side walls. All three of the channels are identical in shape, but located on different cuboid faces. Channel 211 runs along a channel center line, which is a smooth curve, from the middle of the −X edge to the middle of the −Z edge of the +Y cuboid face of cuboid 210. Channel 212 runs along a channel center line, which is a smooth curve, from the middle of the −X edge to the middle of the −Y edge of the −Z cuboid face of cuboid 210. Channel 213 runs along a channel center line, which is a smooth curve, from the middle of the −Z edge to the middle of the −Y edge of the +X cuboid face of cuboid 210. These channels have a depth and width identical to that of the channels in the preferred embodiment(e.g. channel 101).

Figure 18C:
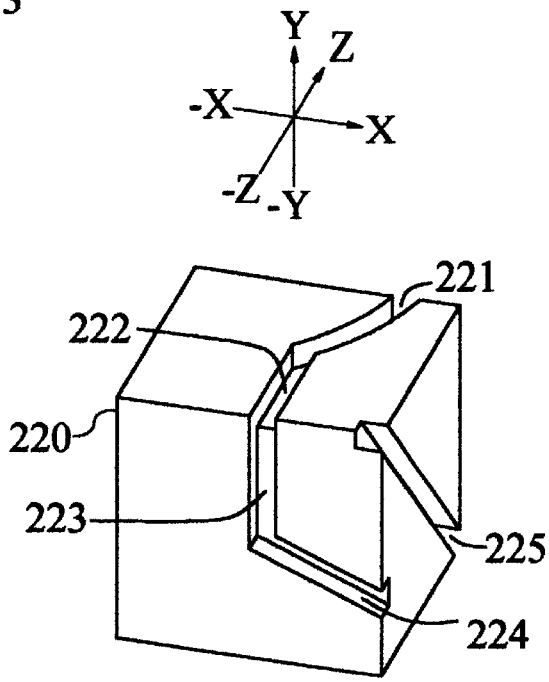
FIG. 18C shows a perspective view of a cuboid with angled channels formed on a plurality of surfaces thereof.

FIG. 18C shows a perspective view of a cuboid, referenced as 220, with several channels at various angles. Cuboid 220 is a cube defining channels 221, 222, 223, 224 and 225. Other than for the addition of these channels cuboid 220 has the shape of a cube. These channels are formed about a center line such that the channel side walls are spaced equidistant from the channel center line. These channel also have vertical side walls. The channel center line for channel 221 is a curved line approximately the shape of one eighth of the arc of a circle, while the channel center lines for channels 222, 223, 224 and 225 are straight lines. Channel 225 is on the +X cuboid face of cuboid 220, and bisects the cuboid face diagonally, from the corner where the +Y and −Z edges meet to where the −Y and +Z edges meet. Channel 223 is a central channel, with a +Y direction, on the −Z cuboid face of cuboid 220. Channel 224 is located on the −Z cuboid face of cuboid 220, and runs from the center of the cuboid face to its +X edge of the cuboid face. Channel 224 intersects with channel 223 at the center of the −Z cuboid face of cuboid 220, such that the angle between the center lines for these channels is approximately 120 degrees at the point where these center lines intersect. Channel 222 is a central channel, with a −Z direction, on the +Y cuboid face of cuboid 220. Channel 221 is located on the +Y cuboid face of cuboid 220, and runs from the center of the cuboid face to a location on +Z edge of the cuboid face that is approximately one quarter of the cuboids width from the cuboids +X cuboid face. Channel 222 intersects with channel 221 at the center of the +Y cuboid face of cuboid 220, such that the angle between the center lines for these channels is approximately 135 degrees at the point where these center lines intersect. These channels have a depth identical to that of the channels in the preferred embodiment (e.g. channel 101). These channels also have width identical to that of the channels in the preferred embodiment, except that at points where 2 channels intersect the channel may be slightly wider due to the overlap of the width of the channels.

Figure 18D:
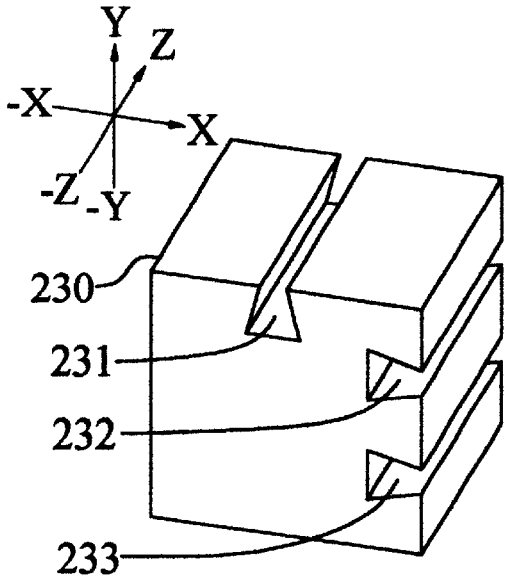
FIG. 18D shows a perspective view of a cuboid having an alternate embodiment of channel.

FIG. 18D shows a perspective view of a cuboid having an alternate embodiment of channel. As this alternate embodiment of channel is the shape of the mortise portion of a dovetail joint, which is commonly used in woodworking, the term dovetail channel will be used as the name of this type of channel. A dovetail channel is defined as having all the properties as defined for a channel, except having some special properties for the channel side walls. In particular the channel side walls are angled with respect to the axis that is perpendicular to the cuboid face into which they are cut, such that the channel width at the cuboid face is smaller than that of the channel width at the extreme depth of the channel, or channel floor. Dovetail channel 231 is a channel on the +Y cuboid face of cuboid 230, with its length parallel to the Z axis, and its widths being parallel to the X axis. It runs from the +Z to the −Z cuboid face along the center of the Y cuboid face. The side walls of dovetail channel 231 are angled approximately 14 degrees with respect to the Y axis, such that the channel is widest at the channel floor. The width of dovetail channel 231 at the +Y cuboid face of cuboid 230 is one half the width measured at the channel floor. Dovetail channel 232 and dovetail channel 233 are the same shape as dovetail channel 231 and are on the +X cuboid face of cuboid 230 with their lengths running parallel to the Z axis. Dovetail channel 232 and dovetail channel 233 are spaced, in the direction along the Y axis, with approximately equal distance between each other and the edges of the +X cuboid face. Other than for the addition of the dovetail channels, cuboid 230 has the shape of a cube.

Figure 18E:
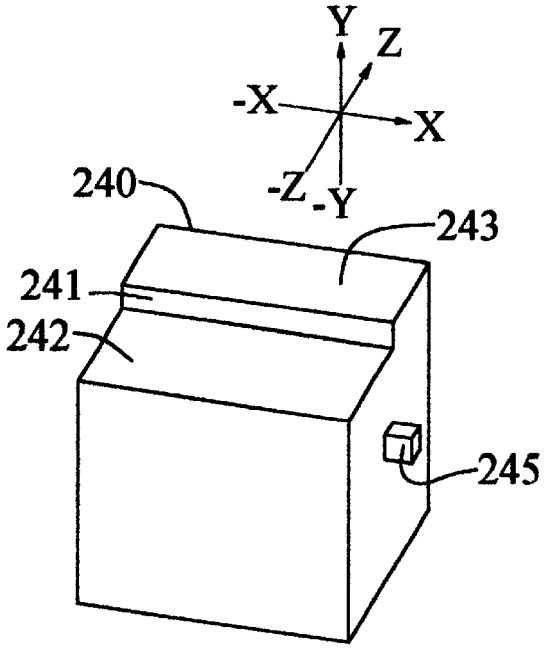
FIG. 18E shows a perspective view of a cuboid having walls and a stud.

FIG. 18E shows a perspective view of a cuboid having two walls and a stud. A wall is a surface defined by the an area on a cuboid face that has been recessed into the cuboid face. The recessed region defines a void and the surfaces of the solid material bounding this void are defined as walls. Wall 241 and 242 are defined by a rectangular area that has been recessed into the plane of the +Y cuboid face of cuboid 240 to form a void. This rectangular area being bordered by the planes of the +X, −X and −Z cuboid faces of cuboid 240, being parallel to +Y cuboid face of the cuboid, and having a width equal to approximately 0.55 times the width of the cuboid. This rectangular area being recessed into the plane of the +Y cuboid face of cuboid 240 in the direction perpendicular to this cuboid face, and by an amount equal to 0.10 times the width of the cuboid. Wall 242 is a planar surface bounding the void, and which is parallel to the rectangular area. Wall 241 is a planar surface bounding the void, and which is perpendicular to the rectangular area. Cuboid face 243 is the resulting +Y cuboid surface of cuboid 240 which excludes the recessed area. Stud 245 is the same shape and size as the studs in the preferred embodiment (e.g. stud 105) and is centrally attached to the +X face of cuboid 240. Other that the void and stud 245, cuboid 240 has the shape of a cube.

Figure 18F:
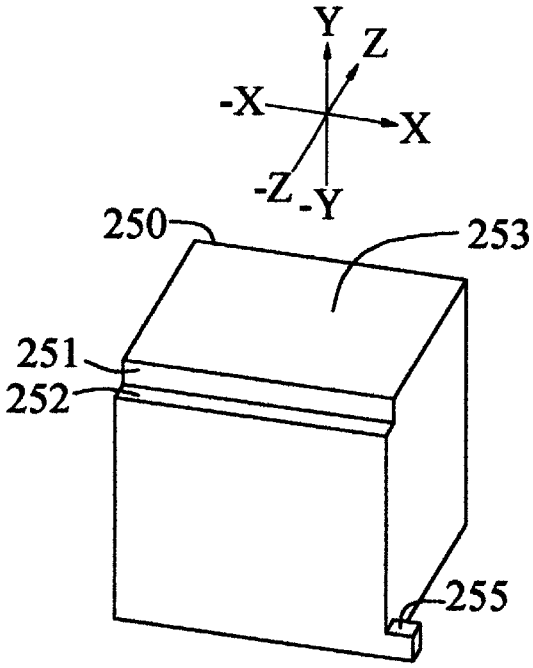
FIG. 18F shows a perspective view of a cuboid having walls and a stud.

FIG. 18F shows a perspective view of a cuboid having two walls and a stud. Wall 251 and 252 are defined by a rectangular area that has been recessed into the plane of the +Y cuboid face of cuboid 250 to form a void. This rectangular area being bordered by the plane of the +X, −X and −Z cuboid faces of cuboid 250, being parallel to +Y cuboid face of the cuboid, and having a width equal to approximately 0.10 times the width of the cuboid. This rectangular area being recessed into the plane of the +Y cuboid face of cuboid 250 in the direction perpendicular to this cuboid face, and by an amount equal to 0.10 times the width of the cuboid. Wall 252 is a planar surface bounding the void, and which is parallel to the rectangular area. Wall 251 is a planar surface bounding the void, and which is perpendicular to the rectangular area. Cuboid face 253 is the resulting +Y cuboid surface of cuboid 250 which excludes the recessed area. Stud 255 is the same shape and size as the studs in the preferred embodiment and is attached to the +X face of cuboid 250 with edges parallel and adjacent to the −Z and −Y edges of the +X cuboid face of cuboid 250. Other that the void and stud 255, cuboid 250 has the shape of a cube.

In accordance with the present invention a interlocking solid puzzle which incorporates a control mechanism with at least one stud and one channel (hereinafter collectively referenced as the "Puzzle with control mechanism".

Functional Description—FIGS. 1 and 2

The puzzle pieces in the preferred embodiment are made of one or more cuboids. The control mechanism for a puzzle involves the interaction between cuboids of puzzle pieces. To better understand the control mechanism, the functionality of the structures on interacting cuboids is explained first.

FIG. 1 is used to explain how studs and channels are used to create some of the basic functionality of the control mechanisms in the preferred embodiment. The Studs and channels can work as a control mechanism when they are present on the contacting faces of adjacent cuboids. More particularly when a stud on one cuboid is engaged in the channel on another cuboid then the movement of one cuboid relative to the other can be restricted and may prevent the pieces from moving in certain directions and/or to certain positions. This can be controlled by the position and length of channels. The channels can act as tracks, or paths for the directional movement of Cuboids within a puzzle. Channels 31 and 32 on cuboid face 23 can be used to control movement of a cuboid that is adjacent to this face. If such a cuboid has a cuboid face flush with cuboid face 23, and it has a stud on its −Y cuboid face, and the edges of these cuboid faces that are in contact are parallel, then its stud would be located where channel 31 and 32 intersect at the center of cuboid face 23. From this position we can see that some movements of such an adjacent cube in directions along the X-Z plane are prevented when stud movement is blocked by channel walls. The adjacent cuboid is prevented from moving in the −X direction by channel side wall 34 at the end of channel 32. It also is prevented from moving in the Z direction by channel side wall 33 at the end of channel 31. The adjacent cuboid can move in the X direction where its stud can move along the length of channel 32. Likewise it can move in the −Z direction along channel 31. During these movements the −Y face of the adjacent cuboid can be said to slide across cuboid face 23. Movements of the adjacent cuboid in directions along the X-Z plane, other than these, are prevented as movement of its stud would be blocked by the walls of channel 31 or 32. Movement of the adjacent cube in the Y direction is possible as it is not blocked. Movement of the adjacent cuboid in the −Y direction is not possible without moving cuboid 20, as cuboid 20 is adjacent in the −Y direction. From the shape and position of channels 29 and 30 we can see that a cuboid with a stud centrally attached to its +Z cuboid face, positioned in a similar adjacent manner to the −Z face of cuboid 20, can be moved in only the X, −X, Y and −Y directions along the X-Y plane.

FIG. 2 is used to explain how mating regions, mating cavities, studs, and channels are used to create some of the basic functionality of the control mechanisms in the preferred embodiment. When a cuboid with a stud is moved next to cuboid 35, such that the stud is completely inserted in mating cavity 36, then the movement of cuboid 35 is restricted. Cuboid 35 can not be moved in directions along the X-Y plane unless the cuboid with the inserted stud is moved right along with it. There can be other voids next to a mating cavity. For example channel 40 creates a void at the mating region on the X cuboid face of cuboid 35. As this region is void of material this creates a mating cavity at that location and next to it are voids from channel 40. When there is not a mating cavity in a mating region this can prevent a cuboid from moving next to another such that their cuboid faces would be flush. When a parallel aligned cuboid with a stud on its −Y face is positioned such that the stud is contacting the Y surface of mating region 38, then this can prevent the cuboids being brought together with their cuboid faces flush. Specifically they can't be move closer together by movement in a direction along the y axis as the stud is impacting against the cuboid material in mating region 38.

The relationship between the width of the studs and channels, and the width of a cuboid, can vary without effecting the functionality. The widths of the studs and channels shown in figs for 1 and 2 are approximately one tenth the width of the cuboids, but larger or smaller channel widths can be used without effecting functionality. The practical upper limit here on channel width is that approaching one third of a cuboid width, as this width can result in the corner sections of cuboids being connected to the rest of the cuboid with a relatively small amount of material. The lower limit on the channel widths would depend on the manufacture of the pieces. This includes the material used, the dimensional tolerance of the pieces, and how much sliding friction we desire between the puzzle pieces.

Functional Description—FIG. 4

FIG. 4 shows an exploded view of a simple puzzle that incorporates the preferred embodiment of my puzzle with control mechanism. This shows the puzzle in a disassembled puzzle configuration.

In puzzle pieces 50, 60, and 90, the adjoining edges of attached cuboids are visible and make the individual cuboids recognizable. In a physical embodiment of a puzzle, it is not necessary for the cuboid edges to be visible.

A puzzle can include additional studs, channels, and mating cavities, that do not act as part of the control mechanism. One function these can serve is to make the puzzle more difficult or challenging to solve. For example additional channels on a puzzle piece present more apparent ways for a puzzle piece with a stud to engage with it for assembly. Another function these can serve is to form recognizable markings or designs on the puzzle. An example of a channel that is not part of the control mechanism is channel 103 on puzzle piece 60 in FIG. 4.

Functional Description—FIG. 5 and FIGS. 12 to 17

FIGS. 5 and FIGS. 12 to 17 will be used to discuss how the puzzle is disassembled. This discussions will include an explanation of how studs, channels, and mating cavities are used to implement control mechanisms. Other functionality of the studs, channels, and mating cavities, is also discussed.

The puzzle in FIG. 5 is disassembled by a series of piece moves. A piece move as defined herein is an uninterrupted change in position of a piece unit along a smooth path. As defined herein the mathematical definition of smooth is used where a smooth path is continuous, and there is not an abrupt change in direction at any point along the path (i.e. the path is agonic). This would preclude there being an angle at any point on a smooth line, or at any point on a line laying on a smooth surface. A piece unit is defined here as one piece, or a plurality of pieces that are in contact with each other and have a relative positional relationship to each other, and when they move they are moved together with this relative positional relationship maintained. Also for piece moves, this refers to the movement of one or more puzzle pieces relative to the other puzzle pieces in the current puzzle configuration. Unless specifically stated otherwise the descriptions use the larger of these two sets of puzzle pieces as a stationary frame of reference when discussing puzzle piece movement. For example we can state that only puzzle piece 50, in the puzzle configuration shown in FIG. 5, can be moved. We do not have to state that this is equivalent to puzzle pieces 60, 80, and 90 being moved in the opposite direction.

The assembled puzzle in FIG. 5 is an interlocking puzzle. As used herein, interlocking means that pieces are united firmly, or joined closely, as by hooking or dovetailing. Interlocking applies to any given configuration of puzzle pieces, e.g. a fully assembled form of a puzzle may, or may not contain any interlocking pieces. Also a partially assembled form of that puzzle, not yet containing all of the pieces, may, or may not contain any interlocking pieces. The definition of interlock allows two pieces to be interlocked where separation of the pieces is possible be relative movement of the pieces along one axis, while separation of the pieces is prevented for movements of the pieces along another axis.

The assembled form of the puzzle in FIG. 5 is also fully interlocked. As defined herein fully interlocked, in terms of a piece unit, means that no piece unit can be separated from the other remaining pieces in a puzzle by a single movement of the piece unit along a smooth path. In other words, a piece move without separation of pieces must occur prior to a piece move that causes pieces to be separated. As defined herein fully interlocked, in terms of a specific piece, means that no piece unit containing that piece can be separated from the other remaining pieces in a puzzle by a single movement of the piece unit along a smooth path. In other words a piece move without separation of pieces must occur prior to a piece move that causes the piece unit containing the specific piece to be separated.

The puzzle in FIG. 5 will also be shown to be a serial interlocking solid puzzle. This is where there is one or more ordered sets of piece moves, and the piece moves from one of these sets is required to assemble or disassemble the puzzle. Sets of piece moves are defined herein to cover situations such as where one set of moves results in an assembled form of the puzzle with pieces in certain relative orientation to each other, and another set of moves that results in an assembled form of the puzzle with the same shape, but where the pieces are in a different relative orientation to each other. Some of the pieces in the puzzle are interlocked in a conventional manner, while some are interlocked using my control mechanism. Interlocking in the conventional manner is where the basic shape of puzzle pieces, i.e. the engaging of faces of puzzle pieces, is used to interlock puzzle pieces. Interlocking using my control mechanism is where a stud on a puzzle piece engages with another puzzle piece to interlock puzzle pieces In a puzzle that has pieces that are based on cube shapes, movements to separate pieces interlocked in a conventional manner is blocked by a cube face coming in contact with another cube face. An example of this is in FIG. 5 when we try to move puzzle piece 80 in the −Z direction. The −Z face of puzzle piece 80 is already in contact with the Z face of cuboid 68 on puzzle piece 60 blocking this movement in the −Z direction. An example of a puzzle piece being interlocked exclusively by my control mechanism is in FIG. 5 when we try to move puzzle piece 80 in the X direction. Here the movement is blocked as the movement of stud 105 on puzzle piece 80 is blocked from movement in the X direction as it is already in contact with a channel side wall in that direction. This is on channel 120 on cuboid 68 of puzzle piece 60, which is shown in FIG. 6. In a likewise manner stud 147 is blocked by a side wall of channel 130. Also stud 146 is blocked by a sidewall of mating cavity 136. Stud 146 and 147 are shown in FIG. 11, and channel 130 and mating cavity 136 are shown in FIG. 8. If studs 105, 146, and 147 were not present puzzle piece 80 could be removed immediately in the X direction.

The structure described herein provides a puzzle wherein there exists a plurality of moves that are required to be performed in a prerequisite order, such that before a specific move can be made there first must be executed a specific set of one or more moves. A piece move can be such that the piece unit moved is separated, or removed from the remaining pieces in the puzzle. Also a piece move can be such that the piece unit is interlocked, with pieces remaining in the puzzle, after the move. The term "move" as used herein means that a piece unit is moved from one position to another position in the puzzle, or removed (i.e. separated) from the puzzle.

The puzzle shown in FIG. 5 is interlocked such that only puzzle piece 50 can be moved. Also it can be moved only in the Y or the −Y directions. As it will be shown that these initial moves can not result in a puzzle piece being removed from the remaining puzzle pieces, the puzzle is also fully interlocked. Puzzle piece 50 can be moved in the −Y direction by an amount equal to a cuboid width. During this piece move, stud 140 on puzzle piece 50 travels a path in the −Y direction with a distance equal to one cuboid width. This path is within channel 143 in puzzle piece 90, and within channel 135 in puzzle piece 60. Channel 143 is shown in FIG. 10 and channel 135 in FIG. 8. Channel 135, and the section of channel 143 in this path, are thus shown to be required for this piece move. This piece move turns out to be a false move. A false move is defined as a piece move that is not required in the solution of a puzzle. In this case this move is not required as a step when disassembling the puzzle starting with the puzzle configuration shown in FIG. 5. The false move is created by the presence of the aforementioned channel sections. The only function of these channel section is to create the false move. This shows that a false move can be added to a puzzle with the addition of my control mechanism, and without effecting the shape of the other pieces in the puzzle.

The first step in disassembly of the puzzle configuration shown if FIG. 5, is the movement of piece 50 in the Y direction by an amount equal to the width of a cuboid. The result of this move is shown in FIG. 12, with an arrow showing the direction which puzzle piece 50 was moved in. Movement of puzzle piece 50 further in the Y direction is prevented by stud 140 being blocked by the channel end wall of channel 131. Stud 140 can be seen in FIG. 9, and channel 131 on puzzle piece 60 in FIG. 8. We have shown that the puzzle in FIG. 5 has no initially removable puzzle pieces, and also no major internal voids. Major voids are those with a shape and size similar to the major components that make up a the bulk of a puzzle piece. In this case a major void would be a void with the shape of a cuboid and having the same width as a cuboid in the puzzle, e.g. cuboid 50.

From the puzzle configuration in FIG. 12 there is only one piece move possible in progressing toward disassembly, i.e. one that is not a false move. The next step in this disassembly is the movement of puzzle pieces 50 and 90 in the −Z direction, by an amount equal to the width of a cuboid. The result of this move is shown in FIG. 13, with an arrow showing the direction in which puzzle pieces 50 and 90 were moved. Movement of these pieces further in the −Z direction is prevented by stud 125 being blocked by the channel end wall of channel 107. Stud 125 can be seen in FIG. 7, and channel 107 in FIG. 4. If studs 125 and 124 were not present then puzzle pieces 50 and 90 could be removed from the puzzle at this time. This would reduce the number of piece moves required to disassemble the puzzle. This shows that the addition of the control mechanism to a puzzle can increase the number of required piece moves for disassembly. This increase in the number of required moves makes the puzzle more interesting and challenging to assemble and disassemble.

From the puzzle configuration in FIG. 13 there are two different piece moves possible in progressing toward disassembly. Either puzzle piece 80 can be removed or puzzle piece 50 can be removed. The next step taken in the disassembly is the removal of puzzle pieces 50 by movement in the Y direction. FIG. 14 shows the puzzle configuration after this piece removal. The next step taken in the disassembly is the removal of puzzle pieces 80 by movement in the Y direction. FIG. 15 shows the a puzzle configuration during the process of this piece removal. This shows stud 105 just emerging from channel 142, the combination of which have been used to control the movement of puzzle piece 80 up to this point in disassembly. Stud 105 can be seen on puzzle piece 80 in FIG. 4, and channel 142 in FIG. 10. FIG. 16 shows the puzzle configuration after puzzle piece 80 has been fully removed.

From the puzzle configuration in FIG. 16 there is only one piece move possible in progressing toward disassembly. The next step in this disassembly is the movement of puzzle pieces 90 in the X direction, by an amount equal to the width of a cuboid. The result of this move is shown in FIG. 17, with an arrow showing the direction in which puzzle pieces 90 was moved. Further piece movement of this direction is prevented by cuboid 98 on puzzle piece 90 being blocked by cuboid 68 on puzzle piece 60. Cuboid 98 and 68 can be seen in FIG. 4.

From the puzzle configuration in FIG. 17 there is only one piece move possible in progressing toward disassembly. The next step taken in the disassembly is the removal of puzzle piece 90 by movement in the Y direction. The result of this piece move is that all puzzle pieces are disconnected from each other and the puzzle is completely disassembled. FIG. 4 shows all the puzzle pieces in a completely disassembled configuration.

This description of the disassembly, along with the associated figures, has shown that movement of pieces is not restricted to that along a single planar or curved surface. Rather the piece movements have included those in directions parallel to three non-planar axes. Also shown is that there does not exist a frame member with a smooth surface that is used to maintain the pieces in assembled form. Rather the pieces are mutually interlocked. One way the pieces have been shown to be interlocked is where removal of a piece is prevented when a cuboid face within one piece is blocked by the cuboid face of another piece. Also the puzzle has included at least one instance of where the removal, or movement of a piece is prevented by the presence of a stud and either a mating cavity or a channel.

Functional Description—FIG. 3

FIG. 3 shows a cuboid with alternate versions of the stud, channel, and mating cavity control structures which are used to create an alternate embodiment of the control mechanism. The control mechanism in this embodiment operates in a similar manner to that of the preferred embodiment, and can be used to restrict piece movement in the same way. For example if we have a cuboid with a T-stud adjacent to cuboid 41, and its stud is within channel 44, then this cuboid can move back and forth in directions along the X axis with the stud traveling within T-channel 44. During this movement the −Y face of this cuboid would be flush with, and slide against the Y face of cuboid 41. When this cuboid moves in the −X direction, such that the T-stud is at the end of T-channel 44, then further movement in this direction is blocked. From this position at the end of the T-channel 44, the cuboid can now be moved in the Z direction with the T-stud traveling within T-channel 45. In a likewise manner a adjacent cuboid with a T-stud within T-channel 43, can be moved in the −X direction to the end of this T-channel, and then be moved in either the Y, or −Y direction within T-channel 42. The major difference in this embodiment is that there now exists a mechanism to control movement in a direction perpendicular to the face of the cuboid containing a stud. For example if we have a cuboid adjacent to cuboid 41, and it has a T-stud positioned within T-channels 44 where it intersects with T-channel 45, then it is blocked from movement in the Y direction. The cuboid can only be separated by a movement in the Z direction where the T-stud can exit the end of T-channel 45, or by a movement in the X direction where the T-stud can exit the end T-channel 44. The −Z face of cuboid 41 contains a T-mating cavity at the intersection of T-channels 42 and 43. This allows a cuboid adjacent to the −Z cuboid face, with a T-stud at this position within the channels, to separate from cuboid 41 via a movement in the −Z direction. This alternate embodiment could also allow voids, with the shape of a T-mating cavity, to be located at positions along a channel other than at the center of a cuboid face. This would allow corresponding positions for cuboids with T-studs and T-channels to be separated or joined.

Functional Description—FIG. 18A

FIG. 18A shows a cuboid with an alternate version of stud which is desirable for use in puzzles that incorporate pieces movements that include rotation. With the diameter of the cylindrical studs the same as the diameter of a channel, this allows a stud to rotate within a channel while remaining in snug contact with the channel walls. For example we can have a cuboid, with a channel on its −Y cuboid face, and its −Y cuboid face in flush contact with the +Y cuboid face of cuboid 200, with cylindrical stud 201 located within the channel. Cuboid 200 could then be rotated on the axis of cylindrical stud 201, with the walls of cylindrical stud 201 remaining in snug contact with the channel of the adjacent stationary cuboid.

Functional Description—FIG. 18B

FIG. 18B shows a cuboid with an alternate version of channel structure which can be used in puzzles that incorporate puzzle pieces movements along curved paths to control such movements. For example we can have a cuboid with a cylindrical stud, such as 201, located on its −Y cuboid face, and with this face in flush contact with the +Y cuboid face of cuboid 210, with the cylindrical stud located within channel 211. As long as the cuboids maintain this flush contact, and the cylindrical stud remains in channel 211, movement of the cylindrical stud, and the cuboid to which it is attached, is restricted to movement along the curved path of channel 211. During such movement the cylindrical stud, and the cuboid to which it is attached, is free to rotate on the axis of the cylindrical stud.

Functional Description—FIG. 18C

FIG. 18C shows a cuboid that includes channels at various angle, that are used to illustrate how the movement of pieces can be controlled in directions other than those provided for in the preferred embodiment. For example we can have a cuboid with a cylindrical stud, such as 201, located on its −X cuboid face, and with this face in flush contact with the +X cuboid face of cuboid 220, with the cylindrical stud located within channel 225. As long as the cuboids maintain this flush contact, and the cylindrical stud remains in channel 225, movement of the cylindrical stud, and the cuboid to which it is attached, is restricted to a movement along the diagonal path of channel 225 which is at a 45 degree angle to the Y axis. Channels 221, 222, 223 and 224 are used to show how the control mechanism can operate where channels intersect at other than a 90 degree angle. For example we can have a cuboid with a cylindrical stud, such as 201, located on its +Z cuboid face, and with this face in flush contact with the −Z cuboid face of cuboid 220, with the cylindrical stud located within channel 223. while the cuboids maintain this flush contact, and the cylindrical stud remains in channel 225, movement of the cylindrical stud, and the cuboid to which it is attached, can move in the −Y direction to the point where channels 223 and 224 intersect and the cylindrical stud is blocked by the channel wall of channel 224. From that point the cylindrical stud, and the cuboid to which it is attached, can start a new move in a new direction along channel 224, which is a change in direction by approximately 120 degrees. In a similar manner we can have a piece movement where a cylindrical stud travels along channel 222 to the point where it is blocked from further movement in the +Z direction by the curved channel wall of channel 221. From that point a new move can be started along the curved channel in an initial direction approximately 135 degrees different from the previous move.

Functional Description—FIG. 18D

FIG. 18D shows a cuboid with an alternate version of channel structure which can be used to create an alternate embodiment of the control mechanism. It also shows that multiple parallel channels can be placed on a cuboid face. The control mechanism in this embodiment operates in a similar manner to that of the preferred embodiment, and can be used to restrict piece movement in the same way. It can operate in a similar manner to that of cuboid 41 in FIG. 3, which contains T-channels, in that there now exists a mechanism to control movement in a direction perpendicular to the face of the cuboid containing a stud. This operation would involve a stud with a profile shape corresponding to that of the profile of the dovetail channel, or dovetail stud, i.e. corresponding in the same way that the profile of the T-Stud matched that of the T-channels in FIG. 3. For example if we have a cuboid with such a dovetail channel on the center of its −Y cuboid face, and the dovetail stud is located within dovetail channel 231 of cuboid 230, then this cuboid is blocked from movement in the +Y direction relative to cuboid 230. This cuboid could only be separated from cuboid 230 by relative movement in the +Z or −Z direction to allow the dovetail stud to slide out of dovetail channel 231. Dovetail channels 232 and 233 are parallel to each other and located on the same cuboid face. This is used to illustrate the point that studs do not have to be located in the center of a cuboid face, as is shown in the preferred embodiment (e.g. stud 105). Rather, different cuboids may have studs in different relative location on their cuboid faces, or a cuboid can have multiple studs on the same face. In order to accommodate this we may need cuboids with multiple parallel channels, such as dovetail channels 232 and 233, when the cuboid is in sliding contact with other cuboids faces of other cuboids which have such studs in such multiple positions.

Functional Description—FIG. 18E

FIG. 18E shows a cuboid that includes walls, that are used to illustrate how the movement of pieces can be controlled along barriers other than channel walls as provided for in the preferred embodiment. For example we can have a cuboid with a stud, such as 245, located on its −Y cuboid face, and with this face in flush contact with cuboid face 243, with a planar face of the stud flush with wall 241. While the cuboid faces remain in flush contact, and the face of the stud remains in contact with wall 241, movement of the adjacent cuboid is blocked in the +Z direction relative to cuboid 240.

Functional Description—FIG. 18F

FIG. 18F shows a cuboid that includes walls, that are used to illustrate that movement of pieces can be controlled by studs and barriers located at positions on pieces other than those provided for in the preferred embodiment. For example we can have a cuboid with a stud, such as 255, located at the corner of its −Y cuboid face, and with this face in flush contact with cuboid face 253, with a planar face of the stud flush with wall 251. While the cuboid faces remain in flush contact, and the face of the stud remains in contact with wall 241, movement of the adjacent cuboid is blocked in the +Z direction relative to cuboid 250.

Functional Description—General

The cuboids and puzzle pieces shown in the figures can be made out of many materials including wood, plastic, metal, and composites. They can be manufactured in different ways as will be recognized by those skilled in the art. Depending on the manufacturing method, the pieces can have a variety of characteristics including being solid, being hollow, and being formed of one or more members permanently attached.

Conclusions, Ramifications, and Scope of Invention

Accordingly, the reader will see that I have created a new class of puzzle, with my interlocking solid puzzles with sliding movement control mechanism. This allows creation of new interlocking solid puzzles that are interesting, appealing, and challenging to assemble and disassemble.

In addition my puzzles with control mechanism can incorporate features used in existing puzzles as would be understood by persons skilled in the art. This includes the material used for the pieces, such as plastic, wood or metal. The material could be transparent, or opaque, and use various colors. The composition of the material, or its surface texture, can be varied to achieve the desired amount of friction between sliding pieces in the puzzle. Features can also includes the application of pictures and symbols to the puzzle pieces via markings, decals, and stickers.

A particular assembled puzzle may consist of a certain set of puzzle pieces drawn from a larger set of puzzle pieces. Also other assembled puzzles may be constructed from other subsets of this large set of pieces. This is a characteristic of existing burr puzzles, where different large sets of pieces are defined. Sets of puzzle pieces that contain subsets of pieces that can be used to construct puzzles with my control mechanism would also fall within the scope of my puzzle with my control mechanism invention.

Also the scope of my puzzle with my control mechanism invention includes puzzles with extra studs, channels, and mating cavities that are not required as part of the control mechanism. These can be used to make the puzzle more difficult and interesting to assemble and disassemble. These can provide for moves that are not required to assemble the puzzle, e.g. blind moves that have to be undone. Also they can merely provide for the appearance of a possible move, i.e. where the move in actuality could not be made. Another use is to provide predetermined or recognizable patterns on the assembled puzzle's surfaces.

A ramification is that the channels, studs, and mating cavities used in my control mechanism, provides structures to allow pieces to interlock with each other in different ways. This interlocking can exist not only in puzzle piece configurations formed during the stages of assembly of a puzzle, but also in other arrangements of puzzle pieces. This can make for an interesting puzzle to play with. Puzzle pieces can be arranged in various interesting stable configurations, which would otherwise easily fall apart if not for the interlocking provided by my control mechanism.

Another ramification is that channels and studs may be used to enable a desired piece to rotate during a move or a certain portion thereof. They can also be used to prevent undesired piece rotation. For example, a channel enabling movement of a piece to a position where it can rotate without its cuboids colliding with those of other pieces. This could be a straight channel at a diagonal angle to cube edges. It would be preferred to have cylindrical shaped studs here for rotation, otherwise the channel would have to be made wide enough for rotation, at least where the stud is rotated. An Example of preventing rotation can be the addition of a stud that would collide with a cuboid of another piece during rotation. Channels may have to be added to pieces to allow assembly with this new stud added.

An advantage is that my control mechanism can be used to improve the ideal class of burr puzzles. This class of burr has the property that a piece can be initially removed from the assembled puzzle without requiring that any piece be moved first. By adding my control mechanism we could make the initial piece non-removable, but movable to a position that would allow the next puzzle piece to move. For some burr puzzles the rest of the moves could be the same shift moves as in the original puzzle. It could also be possible to add more of my control mechanism structures so that even more moves are required to solve the puzzle.

My puzzle has the further advantages in that: (1) it can enable creation of puzzles with a small number of parts, without resorting to deformities, such as rounding the edges of cuboid based puzzle pieces to allow their removal via a rotation; (2) it can be used to add additional puzzle piece moves to an existing puzzle, to create a new and more challenging puzzle, without changing the basic puzzle piece shape from that in the existing puzzle; (3) movement of puzzle pieces is not restricted to that along a single defined smooth surface within the puzzle.

Although the description above contains many specifications, these should not be construed as limiting the scope of my invention but as merely providing illustrations of some of the ways in which the preferred embodiments of my invention can be applied to a particular type and instance of puzzle. Other variations of my control mechanism invention can be shown that help illustrate its broad scope.

One variation is that the assembled puzzle does not have to have the shape of a cube. For example we can have puzzles that have cuboid based puzzle pieces as shown in FIGS. 4 to 17, but when assembled they have the general form of buildings, vehicles, people, animals, or other recognizable or pleasing shapes.

Another variation is that a puzzle can have multiple, different positions for studs, channels, and mating cavities on the face of puzzle pieces. For example in a cuboid based puzzle, as shown in FIGS. 4 to 17, these structures can be located at distances one third of the way across the face of a cuboid instead of half way across. The channel spacing in this example allows two parallel channels on a cuboid face, each one third of the way across the face of a cuboid from opposite edges of a cuboid face. This can also allow multiple studs on a cuboid face, which can be used to implement multiple control mechanisms for piece movements along different paths.

Another variation is that the shape of the studs can be different from that of a cube. For example we can change the shape of the studs in the preferred embodiment to cylinders with the cylinder wall perpendicular to the cuboid face they are on. We can give them a diameter and height the same as the width of the original stud. This shape and size can allow this cylindrical stud to rotate within a channel while at the same time fitting snugly within the channel. If not otherwise obstructed this can allow a puzzle piece to be rotated while remaining captive within the puzzle. This variation can thus create piece moves that include a rotation, or the rotation could be a separate movement that is required for puzzle assembly or disassembly.

Another variation is that channels do not have to be restricted to orientations with their length in a direction parallel to an edges of the puzzle pieces. For example in the puzzle shown in FIGS. 4 through 17 we could include additional channels that run in a path along the diagonal of a cuboid face. By combining this variation with the aforementioned cylindrical shaped stud variation we can retain the same channel width while still achieving a snug fit of the stud in the channel. This combination can allow a piece move to include both a diagonal movement and a rotation.

Another variation is that all channels do not have to be straight along their length. For example in the aforementioned variation with piece rotation, channels with a smooth arc path can be used to accommodate the paths taken by studs on a rotating puzzle piece, which do not lie along the axis of rotation of the piece. In other words the axis of some studs on a rotating puzzle piece can follow a curved path, so may need a likewise curved channel to travel in. As should be apparent, if the axis of rotation of a piece is common with the axis of a cylindrical stud then no additional section of curved channel is needed for this stud to enable rotation, here this stud would just rotate in place.

Another variation is that channels do not have to have 2 channel walls. There could be channels that are voids that have a width that extends clear to one edge of the cuboid face. Here there could be only one channel wall. This can still be used to implement my control mechanism by preventing a piece from being moved to a given position, or removed from the puzzle.

Another variation is that the width of channels and mating cavities do not have to be the same width as the stud such as to have a snug fit. The purpose of the channels and mating cavities, for use as control mechanisms, is to provide one or more barriers, or wall, to prevent a piece from being moved to a given position in a puzzle, or from being removed from a puzzle during assembly or disassembly. When the channel is the same width as the stud, then the stud's path of travel within the channel can only take one smooth path. This minimum channel width path defines the path taken by a piece during a piece move. Even when the channel is a little wider than the stud, where the looseness can allow slight deviations from a smooth path, we still refer to a piece move as being that along the minimum channel width path. We can take this case to further extremes where we can widen a channel clear to an edge of a cube face. As long as there remain channel walls in positions to provide for the control mechanism, e.g. to prevent a piece move to a position or to prevent a piece being removed from the puzzle, then this wider channel would not change the moves required for assembly and disassembly of the puzzle. These moves are still considered to be along the minimum channel width paths, even though the wider channels can allow a piece to have a significant deviation from this path during a piece move. Another case here is where the width of a channel may not be uniform over its length, e.g. it could have curves or abrupt angles along the channel walls. Again as long as there remain channel walls in positions to provide for the control mechanism, e.g. to prevent a piece move to a position or to prevent a piece being removed from the puzzle, then these irregularly shaped channels would not change the moves required for assembly and disassembly of the puzzle. These moves are still considered to be along the minimum channel width paths, even though the irregularly shaped channels can allow a piece to have a significant deviation from this path during a piece move. This shows that making channels or mating cavities larger than the required minimum is a simple variation of my puzzle with control mechanism, and falls within its scope.

Another variation is that we can add or subtract material from the faces of an assembled puzzle with control mechanism, as long as this does not alter the piece moves required for assembly, in such a way as to form aesthetically pleasing or recognizable shapes. This is an existing practice and has been used to create puzzles with shapes such as that of a cube, barrel, or sphere, by adding material to the surfaces of an existing burr puzzle. This practice is discussed on page 63 of the aforementioned book, "Puzzles Old & New". This practice can also be used on puzzles that already have generally recognizable shapes, such as that of buildings, vehicles, people, or animals, to make their shapes smoother or more pleasing.

Another variation and/or advantage is that we can apply the control mechanism to geometric form puzzles to make them more challenging or interesting to assemble or disassemble. As shown in the discussion of the preferred embodiment, we can add studs, channels, and mating cavities, to an existing puzzle to prevent piece moves, and to add additional required, and false piece moves. This can likewise be done to puzzles of various geometric forms to make them more challenging or interesting. We can also start with a simpler version of one of the geometric form puzzles, which would normally be of little challenge due to a small number of pieces, and add additional puzzle moves with my control mechanism. This can produce a puzzle that is less daunting because of its smaller number of pieces, and is interesting and challenging due to the increased number of puzzle moves, and still retains the appealing geometric form. Examples of the type of geometric for puzzles that my control mechanism could be added to are covered in the aforementioned "Puzzles Old & New". Specifically these are the dodecahedron shaped puzzle on page 62, a hexagonal puzzle on page 69, the puzzles called Lightning, Grand Prix, and Kubion on page 76, the puzzles called Cuckoo Nest, and Locked Nest on page 82, the three polyhedral puzzles on page 84, and the puzzle called Jupiter on page 85. As the coverage of these puzzle show, they can have piece movement along more axes, and axes with different angles, than the X, Y, and Z axes used in the description of the cuboid base puzzle shown in FIGS. 4 to 17. Just as shown with the cuboid puzzle, applying this version of my control mechanism can be accomplished with channels positioned on the faces of puzzle pieces, e.g. such that their length runs in a direction along one of the axes of piece movement within the puzzle. Stud locations would then be on the faces of puzzle pieces that slide against those with the channels, and such that the stud would travel in a channel.

Another advantage of the present invention is realized where we can improve an existing puzzle by using my control mechanism for the sole purpose of preventing certain moves. For example there are some burr puzzles that have the property that they can have multiple solutions. This is where the pieces can be assembled into the shape of a burr in more than one way, i.e. with pieces in the puzzle oriented differently to each other. The different solutions can have different numbers of required piece moves. If the puzzle has a solution with a large number of required moves it would be considered very desirable if only the easier solutions did not exist. By addition of my control mechanism to such a puzzle we could prevent some of the piece moves that are present in the easier solutions. This eliminates the easier solutions and make the puzzle much more challenging and desirable.

Another advantage of the present invention is realized in a variation where there is a void internal to the assembled puzzle and the puzzle can be assembled with an object located in this void. This void can be space between puzzle pieces, or can be a void within a piece or pieces (e.g. hollowed out). The void can have a lid on it to retain the object in place. Examples of objects include a prize, treasure, or a valuable.

Another variation is where the solution for a puzzle may not be the transformation of puzzle pieces between an assembled form and a completely disassembled form. Instead it can be the transformation between puzzle pieces in one configuration to another predetermined configuration. One example is the case where two of the pieces in a puzzle can move relative to each other, but can not be separated. In this case the puzzle can not be completely disassembled with all pieces separated from each other. In the extreme of this example we have a puzzle where no pieces can be separated. A solution is in the form of moves to transform the puzzle pieces to another predetermined configuration. One application is where different configurations have recognizable or pleasing shapes.

Another application is where recognizable or pleasing pictures or patterns are formed on surfaces of the puzzle in different configurations. Another application is in a locking mechanism for a container, e.g. a new form of puzzle box. Manipulation of pieces into certain configurations would be used to disengage a member, or members that are preventing the container from being opened.

Another variation is that the assembly or disassembly of a puzzle can include a required sliding rotation of a piece. The rotation can occur as part of a piece move, or be a separate movement. The axis of rotation would be perpendicular to a surface of the piece that would be in sliding contact with the surface of another piece or pieces of the puzzle during this rotation.

Another variation is where there is a containment mechanism for the puzzle pieces. This would be one that does not keep the pieces in assembled form, but keeps pieces from being removed from within a boundary defined by the containment mechanism. In other words the pieces are inside a boundary defined by the containment mechanism and can be assembled and disassembled from each other, but are prevented from leaving the boundary. This containment mechanism could be as simple as cords tied to each piece and fastened to a board, or a more complicated form with a rod attached to each piece with the rods extending through openings in clear plates making up a cube frame around the puzzle pieces.

Additional variations and advantages will be obvious to those skilled in the art. This includes those based on combinations of the above-referenced mentioned variations. Thus the scope of the invention should be determined by the appended claims and their legal equivalents, rather than by the examples given. The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A three-dimensional puzzle capable of being assembled and disassembled, said three-dimensional puzzle comprising:

a plurality of substantially polyhedronally shaped subpieces, each subpiece having a plurality of faces;

said plurality of subpieces forming a plurality of component puzzle pieces, each of said puzzle pieces comprising one or more subpieces wherein said puzzle pieces with more than one subpiece are comprised of subpieces fixedly attached in face-to-face relation, each puzzle piece having a plurality of puzzle piece surfaces;

said plurality of puzzle pieces capable of being assembled in a spatially integrating manner by relative movement thereof to form a three-dimensional assembled configuration wherein at least one of said puzzle pieces is fully interlocked;

said plurality of puzzle pieces capable of being disassembled from said assembled configuration by relative movement thereof;

said movement including movement of puzzle pieces in parallel relation to at least three planes, each of said at least three planes being angled with respect to each other plane;

stud means for blocking certain relative movement of said puzzle pieces during assembly and disassembly, said stud means including first and second projecting studs, said first stud projecting from a first face of a first puzzle piece in a direction along a first axis perpendicular to said first face, said second stud projecting from a second face of one of said puzzle pieces in a direction along a second axis perpendicular to said second face, said first axis disposed in angular relation to said second axis;

said three-dimensional puzzle further including a second puzzle piece having a face with an elongate recessed first channel defined by at least one channel wall, said at least one channel wall defining a first channel path, whereby movement of said first puzzle piece relative to said second puzzle piece causes said first stud to be slidably disposed substantially adjacent to said channel wall wherein said movement terminates by engagement of said first stud with one of said puzzle pieces;

a second channel defined by at least one channel wall defining a second channel path on the same face as said first channel, said first and second channel paths intersecting at an angle.

2. A three-dimensional puzzle according to claim 1, wherein said relative movement is limited to paths defined by straight lines.

3. A three-dimensional puzzle according to claim 1, including one or more guide studs projecting from faces of said plurality of puzzle pieces, and including one or more of said puzzle pieces having at least one face defining a recessed guide channel, said plurality of puzzle pieces including a first and a second mating piece, wherein all said guide channels included in said three-dimensional puzzle have profiles which are substantially the same, and wherein all said guide studs included in said three-dimensional puzzle have shapes and sizes which are substantially the same, and wherein the shape of said guide studs and the profile of said guide channels are such that when said first and second mating pieces are located next to each other wherein opposing faces of said first and second mating pieces are in flush contact wherein one of said first guide studs located on said opposing face of said first mating piece is received within one of said first guide channels located on said opposing face of said second mating piece, said first and second mating pieces can be moved apart by movements in directions perpendicular to said opposing faces wherein said first guide stud is removed from within said first guide channel.

4. A three-dimensional puzzle according to claim 1, wherein said plurality of puzzle pieces are capable of being selectively transformed between a disassembled configuration wherein all of said puzzle pieces are disconnected and separated from one another, and said assembled configuration wherein all of said plurality of puzzle pieces are proximally located and form a three-dimensional structure;

wherein transformation of said puzzle pieces between said assembled and disassembled configurations involves movement of said puzzle pieces including at least one series of piece moves along agonic paths, said at least one series of piece moves including at least one set of required piece moves constituting moves required to achieve transformation, each required piece move consisting of an uninterrupted relative movement of a first piece unit relative to a second piece unit, said first piece unit consisting of one or more of said puzzle pieces wherein the relative position of each puzzle piece is maintained with respect to any other puzzle piece within said first piece unit during said required piece move, said second piece unit consisting of one or more of said puzzle pieces wherein the relative position of each puzzle piece is maintained with respect to any other puzzle piece within said second piece unit during said required piece move.

5. A three-dimensional puzzle according to claim 4, wherein said assembled configuration has all of said plurality of puzzle pieces fully interlocked with exactly one initial piece move possible wherein said initial piece move must be completed prior to any subsequent piece move resulting in one or more said puzzle pieces becoming disconnected and separated from any other said puzzle pieces, said initial piece move and subsequent piece moves being included in said set of required piece moves, whereby said initial piece move must be performed prior to the removal of any said puzzle pieces from said assembled configuration.

6. A three-dimensional puzzle according to claim 4, wherein each said set of required piece moves includes at least three moves wherein at least two of said at least three moves must be completed in a predetermined order relative to at least one other piece move for transformation of said puzzle pieces from said assembled configuration to said disassembled configuration;

each of said set of required piece moves further including moves wherein opposing faces of adjacent puzzle pieces are slidably disposed in substantially adjacent parallel face-to-face relation, and wherein all of said opposing faces that are slidably disposed in face-to-face relation are substantially planar;

said set of required piece moves including movement of puzzle pieces in parallel relation to at least three planes, each of said at least three planes being angled with respect to each other plane by amounts greater than 0 degrees and less than 180 degrees;

said stud being received within said channel during at least a portion of one of said piece moves included in said set of required piece moves thereby limiting relative movement between said first and second puzzle pieces.

7. A three-dimensional puzzle according to claim 1, including a plurality of internal faces included in said plurality of faces, said internal faces being located in the interior of said assembled configuration, wherein at least one said internal face defines a recessed internal channel, wherein any internal voids existing in said assembled configuration between said puzzle pieces are voids formed by said recessed internal channels.

8. A three-dimensional puzzle according to claim 1, wherein there exists at least one said assembled configuration wherein any transformation from said assembled configuration requires at least 2 discrete piece moves defined by said relative movement prior to one or more of said puzzle pieces being separated and disconnected from the remaining said puzzle pieces.

9. A three-dimensional puzzle according to claim 1, further including a plurality of right-angled studs projecting from said plurality of faces, wherein each said right-angled stud forms a polyhedron shape having four rectangular sides walls, each of said right-angled stud side walls projecting perpendicular to said face of the puzzle piece from which said right-angled stud protrudes, wherein said right-angled stud side walls which are adjacent are angled with respect to each other by 90 degrees;

said plurality of faces on said puzzle pieces having a plurality of studs projecting therefrom, wherein all said studs are included in said plurality of right-angled studs.

10. A three-dimensional puzzle according to claim 9, wherein each of said plurality of subpieces is substantially the shape of a cube, wherein each subpiece has substantially the same size;

said relative movement comprised of movements along straight paths;

said right-angled stud side walls having a width of less than one half the width of said subpieces;

each said right-angled stud being located at the center of a face of one of said subpieces.

11. A three-dimensional puzzle according to claim 10, wherein there is exactly one way in which said puzzle pieces can be positioned relative to each other in said assembled configuration to form a substantially cube-shaped structure.

12. A three-dimensional puzzle according to claim 1, wherein said plurality of faces have a plurality of studs projecting therefrom, wherein each of said studs defines a generally square cross-section.

13. A three-dimensional puzzle according to claim 1, wherein said plurality of faces have a plurality of studs projecting therefrom wherein each of said studs defines a generally circular cross-section.

14. A three-dimensional puzzle according to claim 1, wherein said plurality of faces have a plurality of studs projecting therefrom wherein each of said studs defines a generally T-shaped cross-section.

15. A three-dimensional puzzle according to claim 1, wherein said plurality of faces have a plurality of studs projecting therefrom wherein each of said studs defines a generally dovetail-shaped cross-section.

16. A three-dimensional puzzle capable of being assembled and disassembled, said three-dimensional puzzle comprising:

a plurality of rigid three-dimensional puzzle pieces having no moving parts, each of said plurality of puzzle pieces having a plurality of faces, said plurality of puzzle pieces including first and second puzzle pieces;

said first puzzle piece having at least one face defining a recessed channel;

said second puzzle piece having a stud projecting from at least one face thereof;

said plurality of puzzle pieces capable of being selectively transformed between a disassembled configuration wherein all of said puzzle pieces are disconnected and separated from one another, and an assembled configuration wherein all of said plurality of puzzle pieces are proximally located and form a three-dimensional structure;

said assembled configuration including at least one fully interlocked piece unit, said piece unit consisting of one or more of said plurality of puzzle pieces;

wherein transformation of said puzzle pieces between said assembled and disassembled configurations involves movement of said puzzle pieces including at least one series of piece moves along agonic paths, said at least one series of piece moves including at least one set of required piece moves constituting moves required to achieve transformation, each required piece move consisting of an uninterrupted relative movement of a first piece unit relative to a second piece unit, said first piece unit consisting of one or more of said puzzle pieces wherein the relative position of each puzzle piece is maintained with respect to any other puzzle piece within said first piece unit during said required piece move, said second piece unit consisting of one or more of said puzzle pieces wherein the relative position of each puzzle piece is maintained with respect to any other puzzle piece within said second piece unit during said required piece move;

each said set of required piece moves includes at least three moves wherein at least two of said at least three moves must be completed in a predetermined order relative to at least one other piece move for transformation of said puzzle pieces from said assembled configuration to said disassembled configuration;

each of said set of required piece moves further including moves wherein opposing faces of adjacent puzzle pieces are slidably disposed in substantially adjacent parallel face-to-face relation, and wherein all of said opposing faces that are slidably disposed in face-to-face relation are substantially planar;

said set of required piece moves including movement of puzzle pieces in parallel relation to at least three planes, each of said at least three planes being angled with respect to each other plane by amounts greater than 0 degrees and less than 180 degrees;

wherein each of said at least one set of required piece moves includes a first move wherein said first and second puzzle pieces move relative to one another such that opposing faces of said first and second puzzle pieces are in sliding flush contact with said stud received within said channel, and a second move wherein said stud is received within said channel for at least a portion of said second move, wherein said stud travels along a first agonic path within said channel during said first move and said stud travels along a second agonic path within said channel during said second move, said first and second agonic paths intersecting at an angle greater than 0 degrees and less than 180 degrees, said channel located on said opposing face of said first piece, said stud located on said opposing face of said second piece;

said stud being received within said channel during at least a portion of one of said piece moves included in said set of required piece moves thereby limiting relative movement between said first and second puzzle pieces.

17. A three-dimensional puzzle according to claim 16, further including a second channel defined by at least one channel wall defining a third agonic path, said channel and said second channel located on a common face of said first piece, said first agonic path and said third agonic path intersecting at an angle greater than 0 degrees and less than 180 degrees, said first agonic path and said third agonic path being parallel to said common face of said first piece, wherein each set of required piece moves include at least one piece move wherein said first and second puzzle pieces move relative to one another such that opposing faces of said first and second puzzle pieces are in sliding flush contact wherein said stud is received within said second channel, said second channel located on said opposing face of said first puzzle piece, said stud located on said opposing face of said second puzzle piece.

18. A three-dimensional puzzle according to claim 16, including one or more guide studs projecting from faces of said plurality of puzzle pieces, and including one or more of said puzzle pieces having at least one face defining a recessed guide channel, said plurality of puzzle pieces including a first and a second mating piece, wherein all said guide channels included in said three-dimensional puzzle have profiles which are substantially the same, and wherein all said guide studs included in said three-dimensional puzzle have shapes and sizes which are substantially the same, and wherein the shape of said guide studs and the profile of said guide channels are such that when said first and second mating pieces are located next to each other wherein opposing faces of said first and second mating pieces are in flush contact wherein one of said first guide studs located on said opposing face of said first mating piece is received within one of said first guide channels located on said opposing face of said second mating piece, said first and second mating pieces can be moved apart by movements in directions perpendicular to said opposing faces wherein said first guide stud is removed from within said first guide channel.

19. A three-dimensional puzzle according to claim 16, wherein said channel is an elongate recessed channel defined by at least one channel wall, said at least one channel wall defining a channel path, said series of piece moves along agonic paths including movement of said first puzzle piece relative to said second puzzle piece wherein said stud is slidably disposed substantially adjacent to said channel wall wherein said movement terminates by engagement of said stud with one of said puzzle pieces.

20. A three-dimensional puzzle according to claim 16, wherein each of said at least one series of piece moves along agonic paths is comprised of moves along straight paths.

21. A three-dimensional puzzle according to claim 16, wherein said assembled configuration has all of said plurality of puzzle pieces fully interlocked with exactly one initial piece move possible wherein said initial piece move must be completed prior to any subsequent piece move resulting in one or more said puzzle pieces becoming disconnected and separated from any other said puzzle pieces, said initial piece move and subsequent piece moves being included in said set of required piece moves, whereby said initial piece move must be performed prior to the removal of any said puzzle pieces from said assembled configuration.

22. A three-dimensional puzzle according to claim 16, including a plurality of internal faces included in said plurality of faces, said internal faces being located in the interior of said assembled configuration, wherein at least one said internal face defines a recessed internal channel, wherein any internal voids existing in said assembled configuration between said puzzle pieces are voids formed by said recessed internal channels.

23. A three-dimensional puzzle according to claim 16, including a plurality of right-angled studs projecting from said plurality of faces, wherein each said right-angled stud forms a polyhedron shape having four rectangular sides walls, each of said right-angled stud side walls projecting perpendicular to said face of the puzzle piece from which said right-angled stud protrudes, wherein said right-angled stud side walls which are adjacent are angled with respect to each other by 90 degrees;

said plurality of faces on said puzzle pieces having a plurality of studs projecting therefrom, wherein all said studs are right-angled studs.

24. A three-dimensional puzzle according to claim 23, wherein each of said plurality of puzzle pieces is comprised of one or more substantially cube-shaped subpieces wherein said puzzle pieces with more than one subpiece are comprised of subpieces fixedly attached in face-to-face relation, wherein each subpiece has substantially the same size;

said at least one series of piece moves along agonic paths is comprised of moves along straight paths;

said right-angled stud side walls having a width of less than one half the width of said cube-shaped subpieces;

each said right-angled stud being located at the center of a face of one of said cube-shaped subpieces.

25. A three-dimensional puzzle according to claim 16, further including stud means for blocking certain relative movement of said puzzle pieces during assembly and disassembly, said stud means including first and second projecting studs, said first stud projecting from a first face in a direction along a first axis perpendicular to said first face, said second stud projecting from a second face in a direction along a second axis perpendicular to said second face, said first and second faces included in said plurality of faces, said assembled configuration having said first axis disposed in angular relation to said second axis by an angle greater than 0 degrees and less than 180 degrees.

26. A three-dimensional puzzle according to claim 16, wherein there exists at least one said assembled configuration wherein any transformation from said assembled configuration requires at least 2 said required piece moves prior to one or more of said puzzle pieces being separated and disconnected from the remaining said puzzle pieces.

27. A three-dimensional puzzle capable of being assembled and disassembled, said three-dimensional puzzle comprising:

a plurality of rigid three-dimensional puzzle pieces having no moving parts, each of said plurality of puzzle pieces having a plurality of faces, said plurality of puzzle pieces including first and second puzzle pieces;

said first puzzle piece having at least one face defining a recessed channel;

said second puzzle piece having a stud projecting from at least one face thereof;

said plurality of puzzle pieces capable of being selectively transformed between a disassembled configuration wherein all of said puzzle pieces are disconnected and separated from one another, and an assembled configuration wherein all of said plurality of puzzle pieces are proximally located and form a three-dimensional structure;

said assembled configuration having all of said plurality of puzzle pieces fully interlocked with exactly one initial piece move possible wherein said initial piece move must be completed prior to any subsequent piece move resulting in one or more said puzzle pieces becoming disconnected and separated from any other said puzzle pieces, said initial piece move and subsequent piece moves being included in said set of required piece moves, whereby said initial piece move must be performed prior to the removal of any said puzzle pieces from said assembled configuration;

transformation of said puzzle pieces between said assembled and disassembled configurations involving movement of said puzzle pieces including at least one series of piece moves along agonic paths, said at least one series of piece moves including at least one set of required piece moves constituting moves required to achieve transformation, said required piece moves each consisting of an uninterrupted relative movement of a first piece unit relative to a second piece unit, said first piece unit consisting of one or more of said puzzle pieces wherein the relative position of each puzzle piece is maintained with respect to any other puzzle piece within said first piece unit during said required piece move, said second piece unit consisting of one or more of said puzzle pieces wherein the relative position of each puzzle piece is maintained with respect to any other puzzle piece within said second piece unit during said required piece move;

each said set of required piece moves includes at least three moves wherein at least two of said at least three moves must be completed in a predetermined order relative to at least one other piece move for transformation of said puzzle pieces from said assembled configuration to said disassembled configuration;

each said set of required piece moves further including moves wherein opposing faces of adjacent puzzle pieces are slidably disposed in substantially adjacent parallel face-to-face relation, and wherein all of said opposing faces that are slidably disposed in face-to-face relation are substantially planar;

said set of required piece moves including movement of puzzle pieces in parallel relation to at least three planes, each of said at least three planes being angled with respect to each other plane by amounts greater than 0 degrees and less than 180 degrees;

said stud being received within said channel during at least a portion of a piece move included in said set of required piece moves thereby limiting relative movement between said first and second puzzle pieces;

said series of piece moves along agonic paths including at least one move wherein said stud is received within said channel and wherein said at least one move is terminated by engagement of said stud with a portion of one of said plurality of puzzle pieces;

said three-dimensional puzzle including one or more guide studs projecting from faces of said plurality of puzzle pieces, and including one or more of said puzzle pieces having at least one face defining a recessed guide channel, said plurality of puzzle pieces including a first and a second mating piece, wherein all said guide channels included in said three-dimensional puzzle have profiles which are substantially the same, and wherein all said guide studs included in said three-dimensional puzzle have shapes and sizes which are substantially the same, and wherein the shape of said guide studs and the profile of said guide channels are such that when said first and second mating pieces are located next to each other wherein opposing faces of said first and second mating pieces are in flush contact wherein one of said first guide studs located on said opposing face of said first mating piece is received within one of s aid first guide channels located on said opposing face of said second mating piece, said first and second mating pieces can be moved apart by movements in directions perpendicular to said opposing faces wherein said first guide stud is removed from within said first guide channel.

28. A three-dimensional puzzle according to claim 27, wherein all paths included within said at least one series of piece moves along agonic paths are straight paths;

said three-dimensional puzzle comprising:

a plurality of substantially polyhedronally shaped subpieces, each subpiece having a plurality of faces;

said plurality of subpieces forming a plurality of component puzzle pieces, each of said puzzle pieces comprising one or more subpieces wherein said puzzle pieces with more than one subpiece are comprised of subpieces fixedly attached in face-to-face relation, each puzzle piece having a plurality of puzzle piece surfaces;

said subpieces each having substantially the shape of a cube, each said cube being substantially the same size;

said three-dimensional puzzle including a plurality of internal faces included in said plurality of faces, said internal faces being located in the interior of said assembled configuration, wherein at least one said internal face defines a recessed internal channel, wherein any internal voids existing in said assembled configuration between said puzzle pieces are voids formed by said recessed internal channels.

29. A three-dimensional puzzle having a plurality of puzzle pieces capable of being configured in a spatially integrating manner to form a three-dimensional structure, said puzzle pieces capable of being manipulated between a solved configuration and a unsolved configuration by relative movement thereof, said puzzle comprising:

a plurality of rigid three-dimensional puzzle pieces having no moving parts, each of said plurality of puzzle pieces having a plurality of faces, said plurality of puzzle pieces including first and second puzzle pieces;

said first puzzle piece having at least one face defining a recessed channel;

said second puzzle piece having a stud projecting from at least one face thereof;

said plurality of puzzle pieces capable of being selectively transformed between said solved configuration wherein all of said plurality of puzzle pieces are proximally located and form a three-dimensional structure, and said unsolved configuration wherein every possible said solved configuration and said unsolved configuration includes at least two said puzzle pieces which remain proximally located;

said solved configuration including at least one fully interlocked piece unit, said piece unit consisting of one or more of said plurality of puzzle pieces;

wherein transformation of said puzzle pieces between said solved configuration and said unsolved configuration involves movement of said puzzle pieces including at least one series of piece moves along agonic paths, said at least one series of piece moves including at least one set of required piece moves constituting moves required to achieve transformation, said required piece moves each consisting of an uninterrupted relative movement of a first piece unit relative to a second piece unit, said first piece unit consisting of one or more of said puzzle pieces wherein the relative position of each puzzle piece is maintained with respect to any other puzzle piece within said first piece unit during said required piece move, said second piece unit consisting of one or more of said puzzle pieces wherein the relative position of each puzzle piece is maintained with respect to any other puzzle piece within said second piece unit during said required piece move;

each said set of required piece moves includes at least three moves wherein at least two of said at least three moves must be completed in a predetermined order relative to at least one other piece move for transformation of said puzzle pieces from said solved configuration to said unsolved configuration;

each of said set of required piece moves further including moves wherein opposing faces of adjacent puzzle pieces are sidably disposed in substantially adjacent parallel face-to-face relation, and wherein all of said opposing faces that are slidably disposed in face-to-face relation are substantially planar;

said set of required piece moves including movement of puzzle pieces in parallel relation to at least three planes, each of said at least three planes being angled with respect to each other plane by amounts greater than 0 degrees and less than 180 degrees;

wherein each of said at least one set of required piece moves includes a first move wherein said first and second puzzle pieces move relative to one another such that opposing faces of said first and second puzzle pieces are in sliding flush contact with said stud received within said channel, and a second move wherein said stud is received within said channel for at least a portion of said second move, wherein said stud travels along a first agonic path within said channel during said first move and said stud travels along a second agonic path within said channel during said second move, said first and second agonic paths intersecting at an angle greater than 0 degrees and less than 180 degrees, said channel located on said opposing face of said first piece, said stud located on said opposing face of said second piece;

said stud being received within said channel during at least a portion of one of said piece moves included in said set of required piece moves thereby limiting relative movement between said first and second puzzle pieces.

30. A three-dimensional puzzle according to claim 29, further including a second channel defined by at least one channel wall defining a third agonic path, said channel and said second channel located on a common face of said first piece, said first agonic path and said third agonic path intersecting at an angle greater than 0 degrees and less than 180 degrees, said first agonic path and said third agonic path being parallel to said common face of said first piece, wherein each set of required piece moves include piece moves wherein said first and second puzzle pieces move relative to one another such that opposing faces of said first and second puzzle pieces are in sliding flush contact wherein said stud is received within said second channel, said second channel located on said opposing face of said first puzzle piece, said stud located on said opposing face of said second puzzle piece.

31. A three-dimensional puzzle according to claim 29, including a plurality of right-angled studs projecting from said plurality of faces, wherein each said right-angled stud forms a polyhedron shape having four rectangular sides walls, each of said right-angled stud side walls projecting perpendicular to said face of the puzzle piece from which said right-angled stud protrudes, wherein said right-angled stud side walls which are adjacent are angled with respect to each other by 90 degrees;

said plurality of faces on said puzzle pieces having a plurality of studs projecting therefrom, wherein all said studs are included in said plurality of right-angled studs.

32. A three-dimensional puzzle according to claim 29, including one or more guide studs projecting from faces of said plurality of puzzle pieces, and including one or more of said puzzle pieces having at least one face defining a recessed guide channel, said plurality of puzzle pieces including a first and a second mating piece, wherein all said guide channels included in said three-dimensional puzzle have profiles which are substantially the same, and wherein all said guide studs included in said three-dimensional puzzle have shapes and sizes which are substantially the same, and wherein the shape of said guide studs and the profile of said guide channels are such that when said first and second mating pieces are located next to each other wherein opposing faces of said first and second mating pieces are in flush contact wherein one of said first guide studs located on said opposing face of said first mating piece is received within one of said first guide channels located on said opposing face of said second mating piece, said first and second mating pieces can be moved apart by movements in directions perpendicular to said opposing faces wherein said first guide stud is removed from within said first guide channel.

* * * * *